US005596676A

United States Patent [19]

Swaminathan et al.

[11] Patent Number: 5,596,676

[45] Date of Patent: Jan. 21, 1997

[54] MODE-SPECIFIC METHOD AND APPARATUS FOR ENCODING SIGNALS CONTAINING SPEECH

[75] Inventors: Kumar Swaminathan, Gaithersburg; Kalyan Ganesan; Prabhat K. Gupta, both of Germantown, all of Md.

[73] Assignee: Hughes Electronics, Los Angeles, Calif.

[21] Appl. No.: 540,637

[22] Filed: Oct. 11, 1995

Related U.S. Application Data

[60] Division of Ser. No. 229,271, Apr. 18, 1994, which is a continuation-in-part of Ser. No. 227,881, Apr. 15, 1994, which is a continuation-in-part of Ser. No. 905,992, Jun. 25, 1992, Pat. No. 5,495,555, which is a continuation-in-part of Ser. No. 891,596, Jun. 1, 1992, abandoned.

[51] Int. Cl.[6] ..... G10L 9/12; G10L 9/14

[52] U.S. Cl. ..... 395/2.17; 395/2.19; 395/2.28; 395/2.71; 395/2.77

[58] Field of Search ..... 395/2.17, 2.19, 395/2.28, 2.32, 2.71, 2.77

[56] References Cited

U.S. PATENT DOCUMENTS

| | | | |
|---|---|---|---|
| 4,058,676 | 11/1977 | Wilkes et al. | 179/1 |
| 4,771,465 | 9/1988 | Bronson et al. | 381/36 |
| 5,459,814 | 10/1995 | Gupta et al. | 395/2.42 |
| 5,495,555 | 2/1996 | Swaminathan | 395/2.16 |

OTHER PUBLICATIONS

ICC'93, 23 May 1993, Geneva pp. 406–409 P. Lupini et al. 'A multi–mode variable rate CELP coder based on frame classification' see the whole document.

ICASSP 90, vol. 1, 3 Apr. 1990, Albuquerque pp. 477–480 T. Tanguichi et al. 'Combined source and channel coding based on multimode coding' see p. 477 left column, paragraph 1–right column, paragraph 2 see Fig. 1,2.

Atal et al., "A Pattern Recognition Approach to Voiced–Unvoiced–Silence Classification With Applications to Speech Recognition," IEEE Transactions on Acoustics, Speech, and Signal Processing, vol. ASSP–24, No. 3, Jun. 1976.

Rabiner et al., "Application of an LPC Distance Measure to the Voiced–Unvoiced–Silence Detection Problem," IEEE Transactions on Acoustics, Speech, and Signal Processing, vol. ASSP–25, No. 4, Aug. 1977.

*Primary Examiner*—Allen R. MacDonald
*Assistant Examiner*—John Michael Grover
*Attorney, Agent, or Firm*—Gordon R. Lindeen, III; Wanda K. Denson-Low

[57] ABSTRACT

A method for encoding a signal that includes a speech component is described. First and second linear prediction windows of a frame are analyzed to generate sets of filter coefficients. First and second pitch analysis windows of the frame are analyzed to generate pitch estimates. The frame is classified in one of at least two modes, e.g. voiced, unvoiced and noise modes, based, for example, on pitch stationarity, short-term level gradient or zero crossing rate. Then the frame is encoded using the filter coefficients and pitch estimates in a particular manner depending upon the mode determination for the frame, preferably employing CELP based encoding algorithms.

24 Claims, 29 Drawing Sheets

NOTES:

OPTIMUM SET OF INDICES/PARAMETERS AFTER DELAYED DECISION: 1-3-2-4-2-1-1, AC: ADAPTIVE CODEBOOK

--- : MAPPINGS AFTER PRUNING TO BEST AND SECOND BEST SETS, ___ : OPTIMAL PATH, FC: FIXED CODEBOOK

FIG. 21a.

| NOTATION | PARAMETER DESCRIPTION | # BITS |
|---|---|---|
| MODE 1 | MODE BIT 1 | 1 |
| LSP2 | 2nd SET OF LSF INDICES | 26 |
| ACG1 | ADAPTIVE CODEBOOK GAIN INDEX FOR SUBFRAME 1 | 3 |
| ACG3 | ADAPTIVE CODEBOOK GAIN INDEX FOR SUBFRAME 3 | 3 |
| ACG4 | ADAPTIVE CODEBOOK GAIN INDEX FOR SUBFRAME 4 | 3 |
| ACG5 | ADAPTIVE CODEBOOK GAIN INDEX FOR SUBFRAME 5 | 3 |
| ACG7 | ADAPTIVE CODEBOOK GAIN INDEX FOR SUBFRAME 7 | 3 |
| ACG2 | ADAPTIVE CODEBOOK GAIN INDEX FOR SUBFRAME 2 | 3 |
| ACG6 | ADAPTIVE CODEBOOK GAIN INDEX FOR SUBFRAME 6 | 3 |
| PITCH1 | OPEN LOOP PITCH 1 INDEX | 3 |
| PITCH2 | OPEN LOOP PITCH 2 INDEX | 4 |
| ACI1 | ADAPTIVE CODEBOOK INDEX FOR SUBFRAME 1 | 5 |
| SIGN1 | SIGN OF FIXED CODEBOOK GAIN FOR SUBFRAME1 | 1 |
| FCG1 | FIXED CODEBOOK GAIN INDEX FOR SUBFRAME 1 | 4 |
| ACI2 | ADAPTIVE CODEBOOK INDEX FOR SUBFRAME 2 | 5 |
| SIGN2 | SIGN OF FIXED CODEBOOK GAIN FOR SUBFRAME 2 | 1 |
| FCG2 | FIXED CODEBOOK GAIN INDEX FOR SUBFRAME 2 | 3 |
| ACI3 | ADAPTIVE CODEBOOK INDEX FOR SUBFRAME 3 | 5 |
| SIGN3 | SIGN OF FIXED CODEBOOK GAIN FOR SUBFRAME 3 | 1 |
| FCG3 | FIXED CODEBOOK GAIN INDEX FOR SUBFRAME 3 | 4 |
| ACI4 | ADAPTIVE CODEBOOK INDEX FOR SUBFRAME 4 | 5 |
| SIGN4 | SIGN OF FIXED CODEBOOK GAIN FOR SUBFRAME 4 | 1 |
| FCG4 | FIXED CODEBOOK GAIN INDEX FOR SUBFRAME 4 | 3 |

FIG. 21b.

| NOTATION | PARAMETER DESCRIPTION | #BITS |
|---|---|---|
| ACI5 | ADAPTIVE CODEBOOK INDEX FOR SUBFRAME 5 | 5 |
| SIGN5 | SIGN OF FIXED CODEBOOK GAIN FOR SUBFRAME 5 | 1 |
| FCG5 | FIXED CODEBOOK GAIN INDEX FOR SUBFRAME 5 | 4 |
| ACI6 | ADAPTIVE CODEBOOK INDEX FOR SUBFRAME 6 | 5 |
| SIGN6 | SIGN OF FIXED CODEBOOK GAIN FOR SUBFRAME 6 | 1 |
| FCG6 | FIXED CODEBOOK GAIN INDEX FOR SUBFRAME 6 | 3 |
| ACI7 | ADAPTIVE CODEBOOK GAIN INDEX FOR SUBFRAME 7 | 5 |
| SIGN7 | SIGN OF FIXED CODEBOOK GAIN FOR SUBFRAME 7 | 1 |
| FCG7 | FIXED CODEBOOK GAIN INDEX FOR SUBFRAME 7 | 4 |
| FCI12 | FIXED CODEBOOK INDICES COMBINED FOR SUBFRAMES 1 & 2 | 13 |
| FCI34 | FIXED CODEBOOK INDICES COMBINED FOR SUBFRAMES 3 & 4 | 13 |
| FCI56 | FIXED CODEBOOK INDICES COMBINED FOR SUBFRAMES 5 & 6 | 13 |
| FCI7 | FIXED CODEBOOK INDEX FOR SUBFRAME 7 | 7 |
| TOTAL | TOTAL NUMBER OF BITS PER 40 MS FRAME | 168 |

FIG. 22.

| NOTATION | PARAMETER DESCRIPTION | # BITS |
|---|---|---|
| MODE 1 | MODE BIT 1 | 1 |
| LSP2 | 2nd SET OF LSF INDICES | 26 |
| ACG1 | ADAPTIVE CODEBOOK GAIN INDEX FOR SUBFRAME 1 | 3 |
| ACG2 | ADAPTIVE CODEBOOK GAIN INDEX FOR SUBFRAME 2 | 3 |
| ACG3 | ADAPTIVE CODEBOOK GAIN INDEX FOR SUBFRAME 3 | 3 |
| ACG4 | ADAPTIVE CODEBOOK GAIN INDEX FOR SUBFRAME 4 | 3 |
| ACG5 | ADAPTIVE CODEBOOK GAIN INDEX FOR SUBFRAME 5 | 3 |
| ACI1 | ADAPTIVE CODEBOOK INDEX FOR SUBFRAME 1 | 7 |
| FCG1 | FIXED CODEBOOK GAIN INDEX FOR SUBFRAME 1 | 4 |
| FCI1 | FIXED CODEBOOK INDEX FOR SUBFRAME 1 | 9 |
| ACI2 | ADAPTIVE CODEBOOK INDEX FOR SUBFRAME 2 | 7 |
| FCG2 | FIXED CODEBOOK GAIN INDEX FOR SUBFRAME 2 | 4 |
| FCI2 | FIXED CODEBOOK INDEX FOR SUBFRAME 2 | 9 |
| ACI3 | ADAPTIVE CODEBOOK INDEX FOR SUBFRAME 3 | 7 |
| FCG3 | FIXED CODEBOOK GAIN INDEX FOR SUBFRAME 3 | 4 |
| FCI3 | FIXED CODEBOOK INDEX FOR SUBFRAME 3 | 9 |
| ACI4 | ADAPTIVE CODEBOOK INDEX FOR SUBFRAME 4 | 7 |
| FCG4 | FIXED CODEBOOK GAIN INDEX FOR SUBFRAME 4 | 4 |
| FCI4 | FIXED CODEBOOK INDEX FOR SUBFRAME 4 | 9 |
| ACI5 | ADAPTIVE CODEBOOK INDEX FOR SUBFRAME 5 | 7 |
| FCG5 | FIXED CODEBOOK GAIN INDEX FOR SUBFRAME 5 | 4 |
| FCI5 | FIXED CODEBOOK INDEX FOR SUBFRAME 5 | 9 |
| LSP1 | 1st SET OF LSF INDICES | 25 |
| MODE2 | MODE BIT 2 | 1 |
| TOTAL | TOTAL NUMBER OF BITS PER 40 MS FRAME | 168 |

FIG. 23.

| NOTATION | PARAMETER DESCRIPTION | # BITS |
|---|---|---|
| MODE 1 | MODE BIT 1 | 1 |
| LSP2 | 2nd SET OF LSF INDICES | 26 |
| ACG1 | ADAPTIVE CODEBOOK GAIN INDEX FOR SUBFRAME 1 | 3 |
| ACG2 | ADAPTIVE CODEBOOK GAIN INDEX FOR SUBFRAME 2 | 3 |
| ACG3 | ADAPTIVE CODEBOOK GAIN INDEX FOR SUBFRAME 3 | 3 |
| ACG4 | ADAPTIVE CODEBOOK GAIN INDEX FOR SUBFRAME 4 | 3 |
| ACG5 | ADAPTIVE CODEBOOK GAIN INDEX FOR SUBFRAME 5 | 3 |
| ACI1 | ADAPTIVE CODEBOOK INDEX FOR SUBFRAME 1 | 7 |
| FCG2_1 | FIXED CODEBOOK GAIN INDEX 2 FOR SUBFRAME 1 | 5 |
| FCI1 | FIXED CODEBOOK INDEX FOR SUBFRAME 1 | 8 |
| ACI2 | ADAPTIVE CODEBOOK INDEX FOR SUBFRAME 2 | 7 |
| FCG2_2 | FIXED CODEBOOK GAIN INDEX 2 FOR SUBFRAME 2 | 5 |
| FCI2 | FIXED CODEBOOK INDEX FOR SUBFRAME 2 | 8 |
| ACI3 | ADAPTIVE CODEBOOK INDEX FOR SUBFRAME 3 | 7 |
| FCG2_3 | FIXED CODEBOOK GAIN INDEX 2 FOR SUBFRAME 3 | 5 |
| FCI3 | FIXED CODEBOOK INDEX FOR SUBFRAME 3 | 8 |
| ACI4 | ADAPTIVE CODEBOOK INDEX FOR SUBFRAME 4 | 7 |
| FCG2_4 | FIXED CODEBOOK GAIN INDEX 2 FOR SUBFRAME 4 | 5 |
| FCI_4 | FIXED CODEBOOK INDEX FOR SUBFRAME 4 | 8 |
| ACI5 | ADAPTIVE CODEBOOK INDEX FOR SUBFRAME 5 | 7 |
| FCG2_5 | FIXED CODEBOOK GAIN INDEX 2 FOR SUBFRAME 5 | 5 |
| FCI5 | FIXED CODEBOOK INDEX FOR SUBFRAME 5 | 8 |
| FCG1_1 | FIXED CODEBOOK GAIN INDEX 1 FOR SUBFRAME 1 | 5 |
| FCG1_2 | FIXED CODEBOOK GAIN INDEX 1 FOR SUBFRAME 2 | 5 |
| FCG1_3 | FIXED CODEBOOK GAIN INDEX 1 FOR SUBFRAME 3 | 5 |
| FCG1_4 | FIXED CODEBOOK GAIN INDEX 1 FOR SUBFRAME 4 | 5 |
| FCG1_5 | FIXED CODEBOOK GAIN INDEX 1 FOR SUBFRAME 5 | 5 |
| MODE2 | MODE BIT 2 | 1 |
| TOTAL | TOTAL NUMBER OF BITS PER 40 MS FRAME | 168 |

MODE-SPECIFIC METHOD AND APPARATUS FOR ENCODING SIGNALS CONTAINING SPEECH

BACKGROUND OF THE INVENTION

This is a division of application Ser. No. 08/229,271 filed Apr. 18, 1994, which is a continuation-in-part of prior application Ser. No. 08/227,881 filed Apr. 15, 1994, of Kumar Swaminathan, Kalyan Ganesan, and Prabhat K. Gupta for METHOD OF ENCODING A SIGNAL CONTAINING SPEECH, which is a continuation-in-part of prior application Ser. No. 07/905,992, filed Jun. 25, 1992, of Kumar Swaminathan for HIGH QUALITY LOW BIT RATE CELP-BASED SPEECH CODEC, issued as U.S. Pat. No. 5,495,555, which is a continuation-in-part application under 37 C.F.R. §1.162 of prior application Ser. No. 07/891,596, filed Jun. 1, 1992, of Kumar Swaminathan for CELP EXCITATION ANALYSIS FOR VOICED SPEECH (abandoned). The contents of patent application Ser. No. 07/905,992 entitled "HIGH QUALITY LOW BIT RATE CELP-BASED SPEECH CODEC" are hereby incorporated by reference.

FIELD OF THE INVENTION

The present invention generally relates to a method of encoding a signal containing speech and more particularly to a method employing a linear predictor to encode a signal.

DESCRIPTION OF THE RELATED ART

A modern communication technique employs a Codebook Excited Linear Prediction (CELP) coder. The codebook is essentially a table containing excitation vectors for processing by a linear predictive falter. The technique involves partitioning an input signal into multiple portions and, for each portion, searching the codebook for the vector that produces a filter output signal that is closest to the input signal.

The typical CELP technique may distort portions of the input signal dominated by noise because the codebook and the linear predictive filter that may be optimum for speech may be inappropriate for noise.

OBJECT AND SUMMARY OF THE INVENTION

It is an object of the present invention to provide a method of encoding a signal containing both speech and noise while avoiding some of the distortions introduced by typical CELP encoding techniques.

Additional objectives and advantages of the invention will be set forth in the description that follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method of processing a signal having a speech component, the signal being organized as a plurality of frames, is used. The method comprises the steps, performed for each frame, of determining whether the frame corresponds to a first mode, depending on whether the speech component is substantially absent from the frame; generating an encoded frame in accordance with one of a first coding scheme, when the frame corresponds to the first mode, and a second coding scheme when the frame does not correspond to the first mode; and decoding the encoded frame in accordance with one of the first coding scheme, when the frame corresponds to the first mode, and the second coding scheme when the frame does not correspond to the first mode.

BRIEF DESCRIPTION OF THE DRAWINGS

The foregoing and other objects, aspects and advantages will be better understood from the following detailed description of a preferred embodiment of the invention with reference to the drawings, in which:

FIGS. 22A and 22B show a chart of speech coder parameters for mode A;

FIG. 23 is a chart of speech coder parameters for mode A;

FIG. 21 is a timing diagram showing an alternative alignment of linear prediction analysis windows.

DETAILED DESCRIPTION OF A PREFERRED EMBODIMENT OF THE INVENTION

Figure 1:
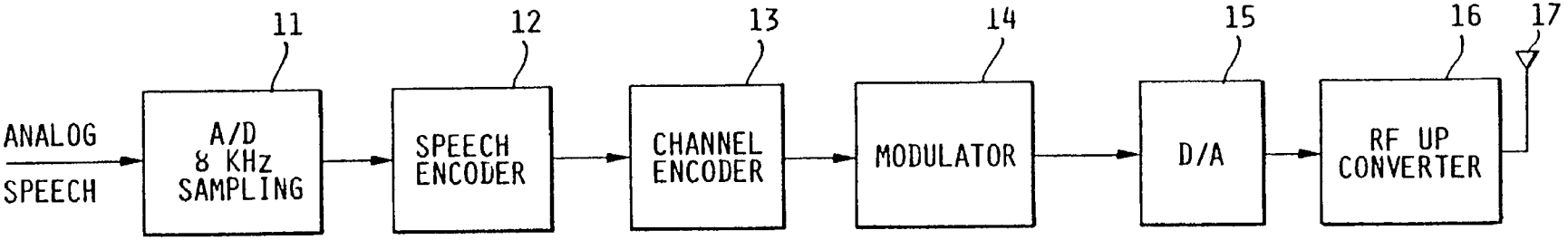
FIG. 1 is a block diagram of a transmitter in a wireless communication system according to a preferred embodiment of the invention.

FIG. 1 shows the transmitter of the preferred communication system. Analog-to-digital (A/D) converter 11 samples analog speech from a telephone handset at an 8 KHz rate, converts to digital values and supplies the digital values to the speech encoder 12. Channel encoder 13 further encodes the signal, as may be required in a digital cellular communications system, and supplies a resulting encoded bit stream to a modulator 14. Digital-to-analog (D/A) converter 15 converts the output of the modulator 14 to Phase Shift Keying (PSK) signals. Radio frequency (RF) up converter 16 amplifies and frequency multiplies the PSK signals and supplies the amplified signals to antenna 17.

A low-pass, antialiasing, filter (not shown) filters the analog speech signal input to A/D converter 11. A high-pass, second order biquad, filter (not shown) filters the digitized samples from A/D converter 11. The transfer function is:

$$H_{HP}(Z) = \frac{1 - 2Z^{-1} + Z^{-2}}{1 - 1.8891Z^{-1} + 0.89503Z^{-2}}$$

The high pass filter attenuates D.C. or hum contamination may occur in the incoming speech signal.

Figure 2:
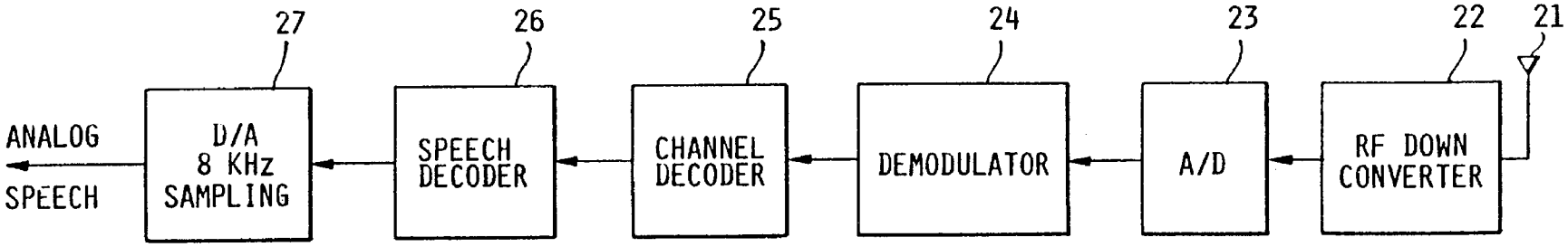
FIG. 2 is a block diagram of a receiver in a wireless communication system according to the preferred embodiment of the invention.

FIG. 2 shows the receiver of the preferred communication system. RF down converter 22 receives a signal from antenna 21 and heterodynes the signal to an intermediate frequency (IF). A/D converter 23 converts the IF signal to a digital bit stream, and demodulator 24 demodulates the resulting bit stream. At this point the reverse of the encoding process in the transmitter takes place. Channel decoder 25 and speech decoder 26 perform decoding. D/A converter 27 synthesizes analog speech from the output of the speech decoder.

Much of the processing described in this specification is performed by a general purpose signal processor executing program statements. To facilitate a description of the preferred communication system, however, the preferred communication system is illustrated in terms of block and circuit diagrams. One of ordinary skill in the art could readily transcribe these diagrams into program statements for a processor.

Figure 3:
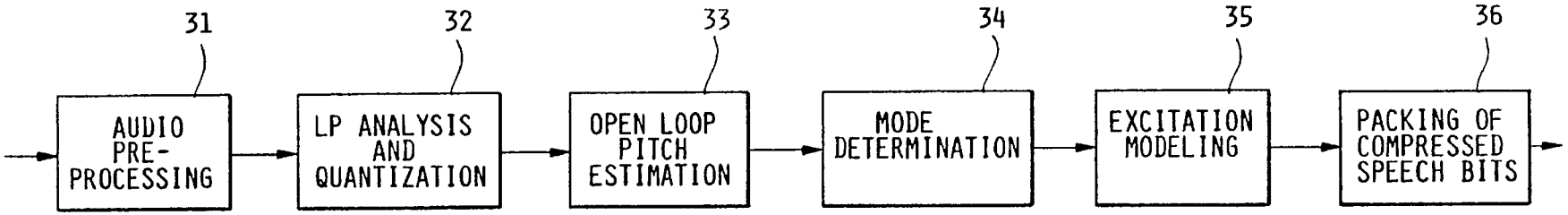
FIG. 3 is block diagram of the encoder in the transmitter shown in FIG. 1.

FIG. 3 shows the encoder 12 of FIG. 1 in more detail, including an audio preprocessor 31, linear predictive (LP) analysis and quantization module 32, and open loop pitch estimation module 33. Module 34 analyzes each frame of the signal to determine whether the frame is mode A, mode B, or mode C, as described in more detail below. Module 35 performs excitation modelling depending on the mode determined by module 34. Processor 36 compacts compressed speech bits.

Figure 4:
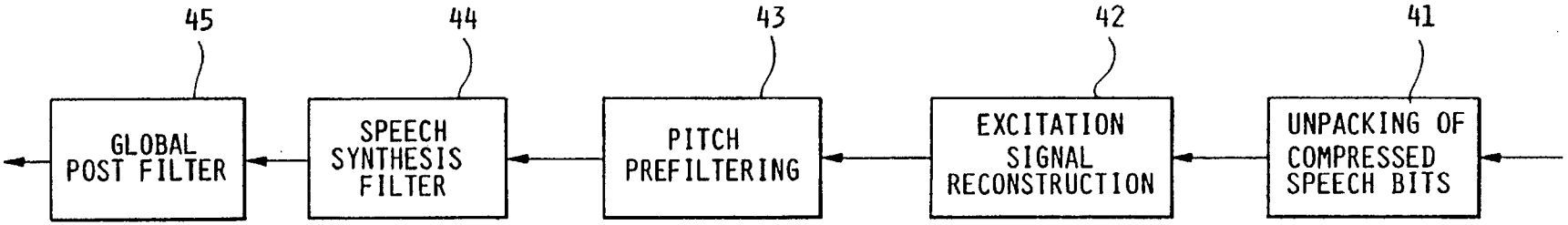
FIG. 4 is a block diagram of the decoder in the receiver shown in FIG. 2.

FIG. 4 shows the decoder 26 of FIG. 2, including a processor 41 for unpacking of compressed speech bits, module 42 for excitation signal reconstruction, filter 43, speech synthesis filter 44, and global post filter 45.

Figure 5A:
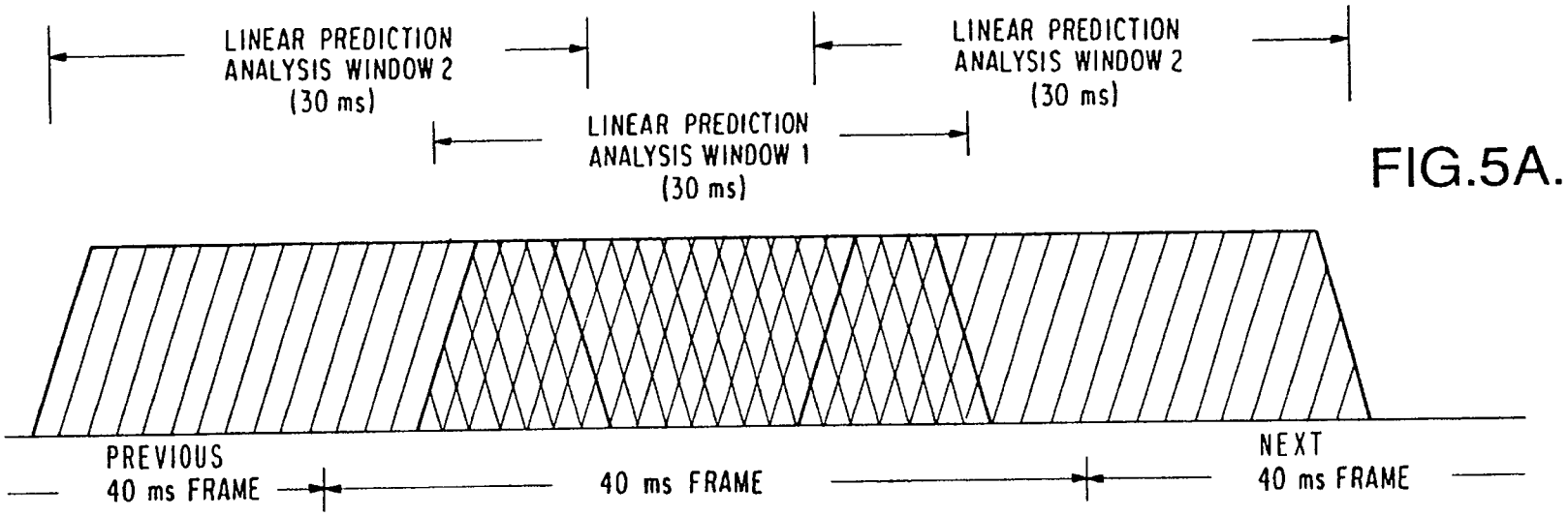
FIG. 5A is a timing diagram showing the alignment of linear prediction analysis windows in the encoder shown in FIG. 3.

FIG. 5A shows linear prediction analysis windows. The preferred communication system employs 40 ms. speech frames. For each frame, module 32 performs LP (linear prediction) analysis on two 30 ms. windows that are spaced apart by 20 ms. The first LP window is centered at the middle, and the second LP window is centered at the leading edge of the speech frame such that the second LP window extends 15 ms. into the next frame. In other words, module 32 analyzes a first part of the frame (LP window 1) to generate a first set of filter coefficients and analyzes a second part of the frame and a part of a next frame (LP window 2) to generate a second set of filter coefficients.

Figure 5B:
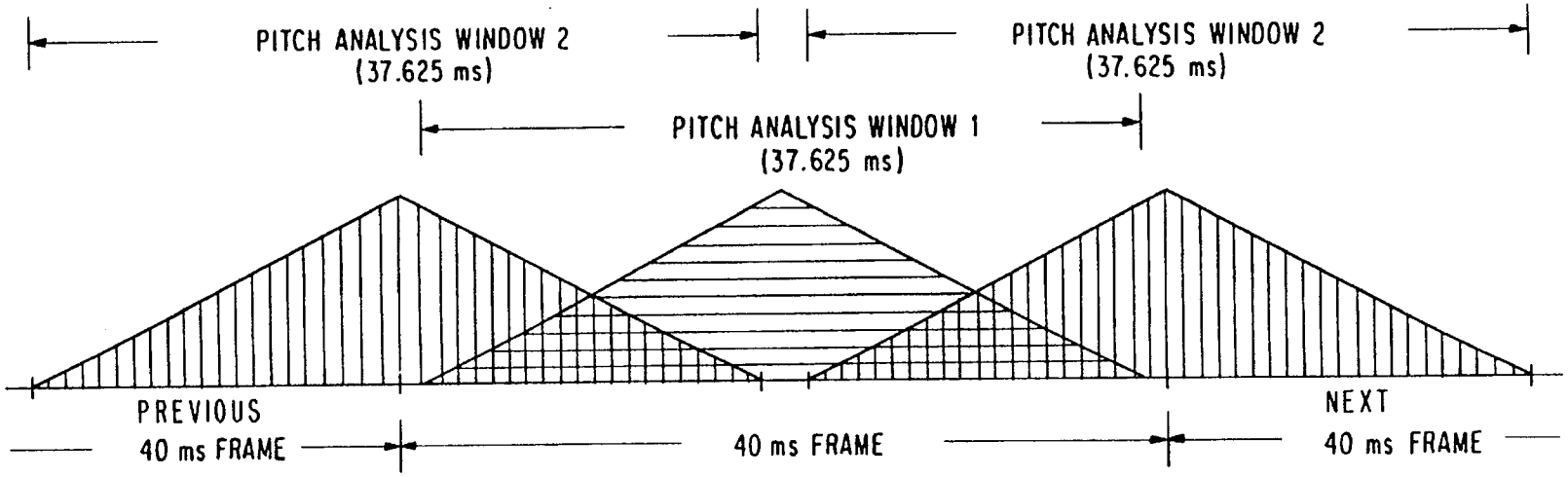
FIG. 5B is a timing diagram showing the alignment of pitch prediction analysis windows for open loop pitch prediction in the encoder shown in FIG. 3.

FIG. 5B shows pitch analysis windows. For each frame, module 32 performs pitch analysis on two 37.625 ms. windows. The first pitch analysis window is centered at the middle, and the second pitch analysis window is centered at the leading edge of the speech frame such that the second pitch analysis window extends 18.8125 ms. into the next frame. In other words, module 32 analyzes a third part of the frame (pitch analysis window 1) to generate a first pitch estimate and analyzes a fourth part of the frame and a part of the next frame (pitch analysis window 2) to generate a second pitch estimate.

Module 32 employs multiplication by a Hamming window followed by a tenth order autocorrelation method of LP analysis. With this method of LP analysis, module 32 obtains optimal filter coefficients and optimal reflection coefficients. In addition, the residual energy after LP analysis is also readily obtained and, when expressed as a fraction of the speech energy of the windowed LP analysis buffer, is denoted as $\alpha_1$ for the first LP window and $\alpha_2$ for the second LP window. These outputs of the LP analysis are used subsequently in the mode selection algorithm as measures of spectral stationarity, as described in more detail below.

After LP analysis, module 32 bandwidth broadens the filter coefficients for the first LP window, and for the second LP window, by 25 Hz, converts the coefficients to ten line spectral frequencies (LSF), and quantizes these ten line spectral frequencies with a 26-bit LSF vector quantization (VQ), as described below.

Module 32 employs a 26-bit vector quantization (VQ) for each set of ten LSFs. This VQ provides good and robust performance across a wide range of handsets and speakers. Separate VQ codebooks are designed for "IRS filtered" and "flat unfiltered" ("non-IRS-filtered") speech material. The unquantized LSF vector is quantized by the "IRS filtered" VQ tables as well as the "flat unfiltered" VQ tables. The optimum classification is selected on the basis of the cepstral distortion measure. Within each classification, the vector quantization is carried out. Multiple candidates for each split vector are chosen on the basis of energy weighted mean square error, and an overall optimal selection is made within each classification on the basis of the cepstral distortion measure among all combinations of candidates. After the optimum classification is chosen, the quantized line spectral frequencies are converted to filter coefficients.

More specifically, module 32 quantizes the ten line spectral frequencies for both sets with a 26-bit multi-codebook split vector quantizer that classifies the unquantized line spectral frequency vector as a "voiced IRS-filtered," "unvoiced IRS-filtered," "voiced non-IRS-filtered," and "unvoiced non-IRS-filtered" vector, where "IRS" refers to intermediate reference system filter as specified by CCITT, Blue Book, Rec.P.48.

Figure 6A:
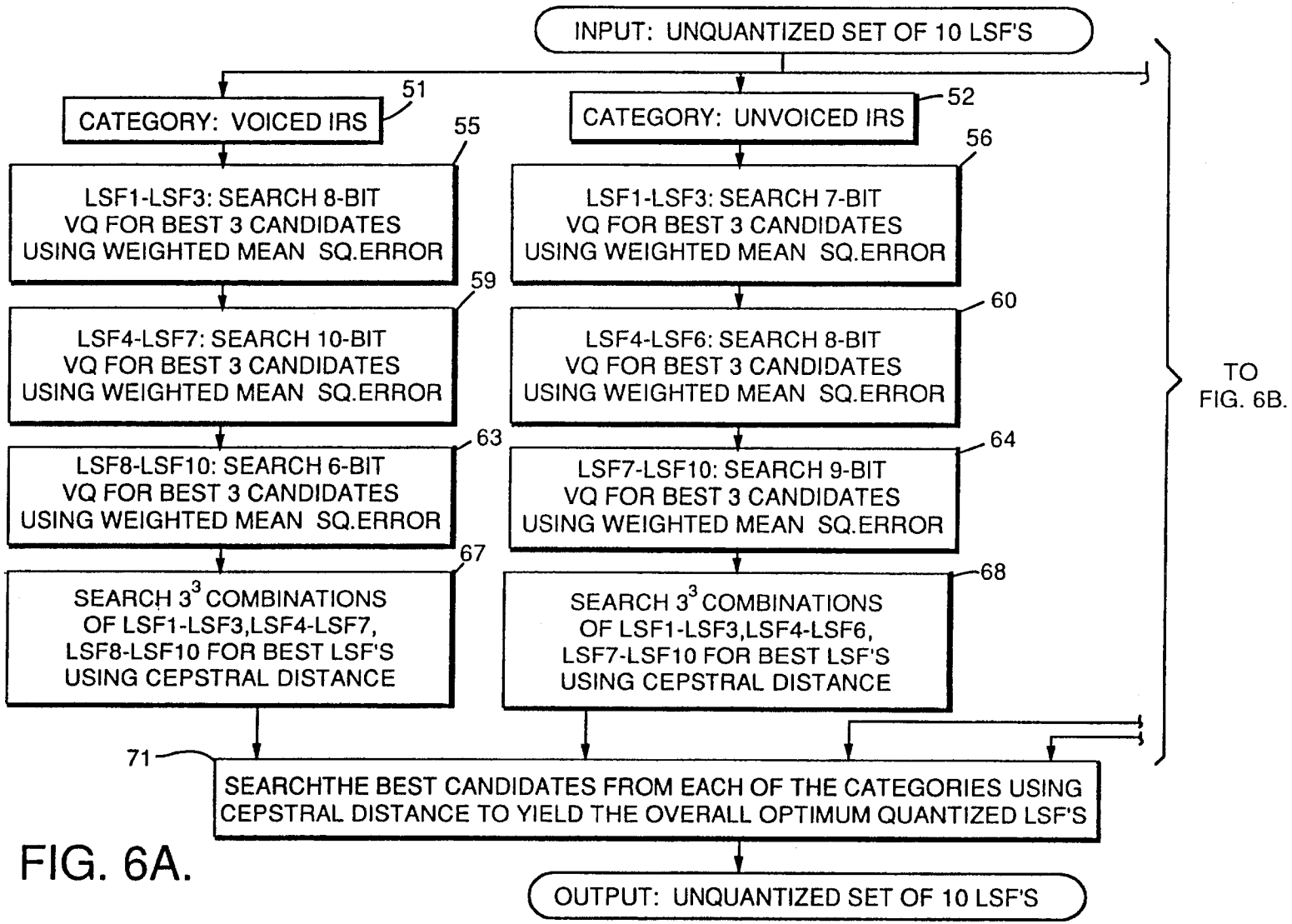
FIGS. 6A and 6B show a flowchart illustrating the 26-bit line spectral frequency vector quantization process performed by the encoder of FIG. 3.
Figure 6B:
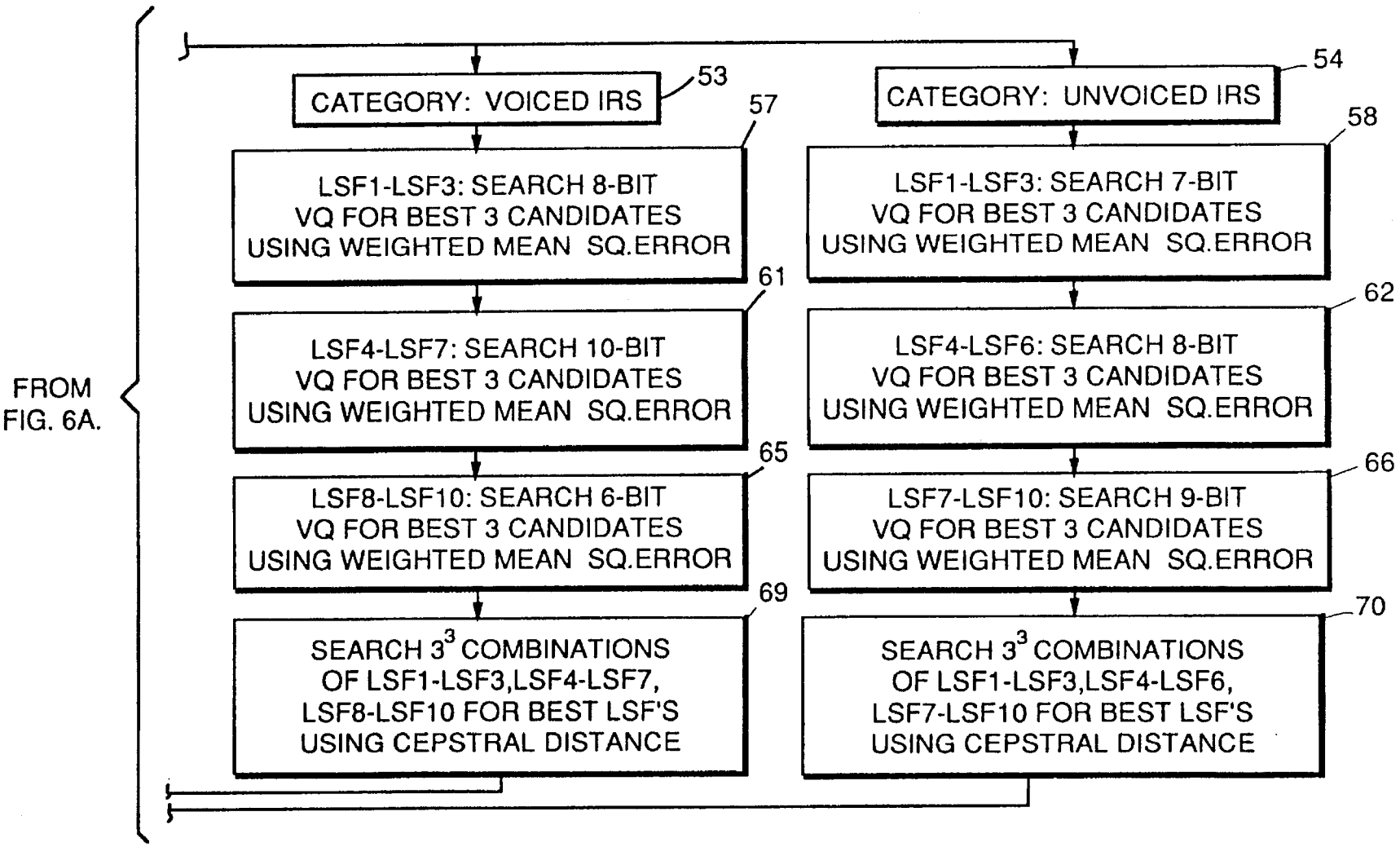

FIGS. 6A and 6B show an outline of the LSF vector quantization process. Module 32 employs a split vector quantizer for each classification, including a 3-4-3 split vector quantizer for the "voiced IRS-filtered" and the "voiced non-IRS-filtered" categories 51 and 53. The first three LSFs use an 8-bit codebook in function modules 55 and 57, the next four LSFs use a 10-bit codebook in function modules 59 and 61, and the last three LSFs use a 6-bit codebook in function modules 63 and 65. For the "unvoiced IRS-filtered" and the "unvoiced non-IRS-filtered" categories 52 and 54, a 3-3-4 split vector quantizer is used. The first three LSFs use a 7-bit codebook in function modules 56 and 58, the next three LSFs use an 8-bit vector codebook in function modules 60 and 62, and the last four LSFs use a 9-bit codebook in function modules 64 and 66. From each split vector codebook, the three best candidates are selected in function modules 67, 68, 69, and 70 using the energy weighted mean square error criteria. The energy weighting reflects the power level of the spectral envelope at each line spectral frequency. The three best candidates for each of the three split vectors result in a total of twenty-seven combinations for each category. The search is constrained so that at least one combination would result in an ordered set of LSFs. This is usually a very mild constraint imposed on the search. The optimum combination of these twenty-seven combinations is selected in function module 71 depending on the cepstral distortion measure. Finally, the optimal category or classification is determined also on the basis of the cepstral distortion measure. The quantized LSFs are converted to filter coefficients and then to autocorrelation lags for interpolation purposes.

The resulting LSF vector quantizer scheme is not only effective across speakers but also across varying degrees of IRS filtering which models the influence of the handset transducer. The codebooks of the vector quantizers are trained from a sixty talker speech database using flat as well as IRS frequency shaping. This is designed to provide consistent and good performance across several speakers and across various handsets. The average log spectral distortion across the entire TIA half rate database is approximately 1.2 dB for IRS filtered speech data and approximately 1.3 dB for non-IRS filtered speech data.

Two estimates of the pitch are determined per free at intervals of 20 msec. These open loop pitch estimates are used in mode selection and to encode the closed loop pitch analysis if the selected mode is a predominantly voiced mode.

Figure 7:
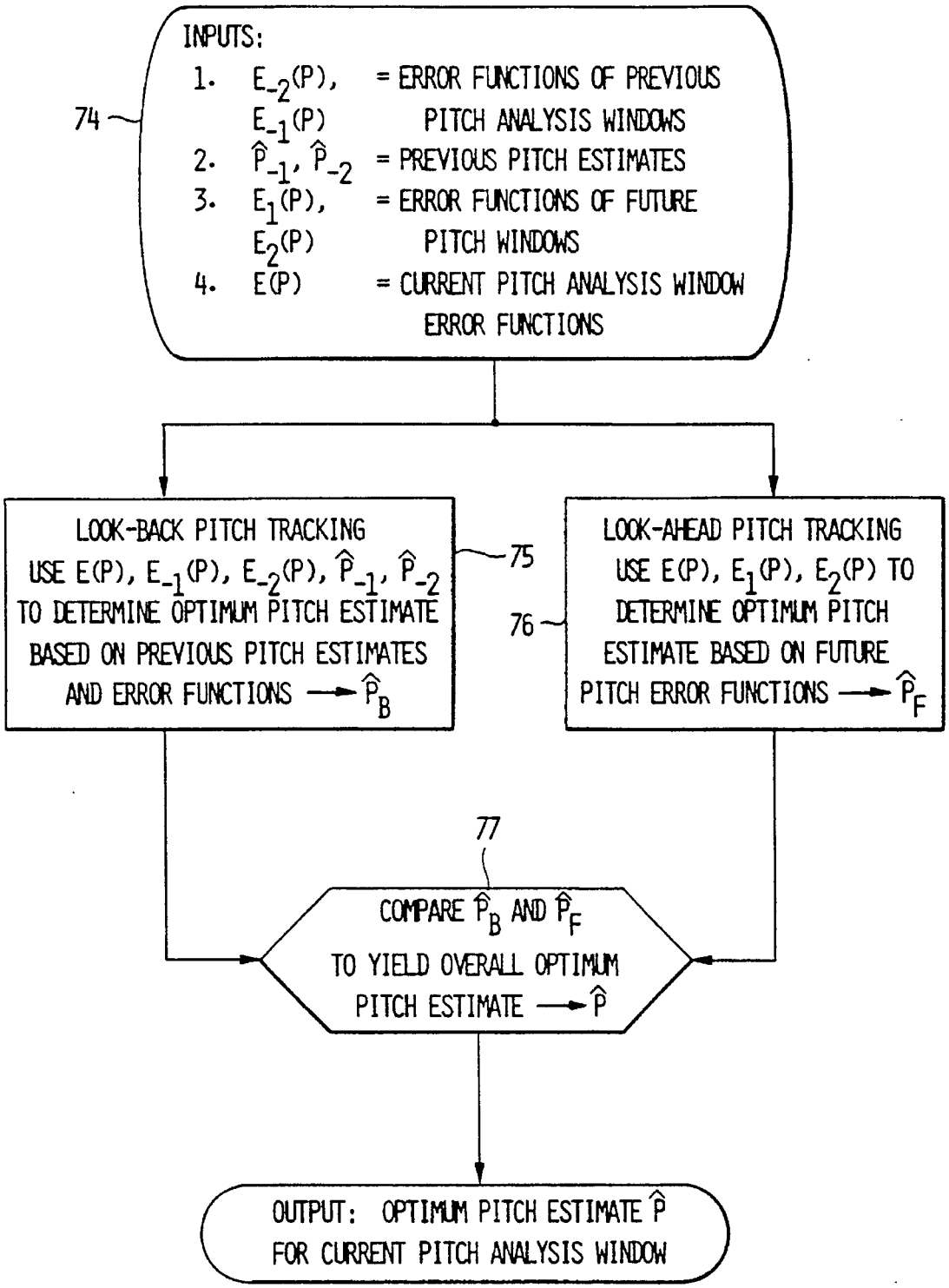
FIG.7. ( PRIOR ART )
FIG. 7 is a flowchart illustrating the operation of a pitch tracking algorithm.

Module 33 determines the two pitch estimates from the two pitch analysis windows described above in connection with FIG. 5B, using a modified form of the pitch tracking algorithm shown in FIG. 7. This pitch estimation algorithm makes an initial pitch estimate in function module 73 using an error function calculated for all values in the set {(22.0, 22.5, . . . , 114.5}, followed by pitch tracking to yield an overall optimum pitch value. Function module 74 employs look-back pitch tracking using the error functions and pitch estimates of the previous two pitch analysis windows. Function module 75 employs look-ahead pitch tracking using the error functions of the two future pitch analysis windows. Decision module 76 compares pitch estimates depending on look-back and look-ahead pitch tracking to yield an overall optimum pitch value at output 77. The pitch estimation algorithm shown in FIG. 7 requires the error functions of two future pitch analysis windows for its look-ahead pitch tracking and thus introduces a delay of 40 ms. In order to avoid this penalty, the preferred communication system employs a modification of the pitch estimation algorithm of FIG. 7.

Figure 8:
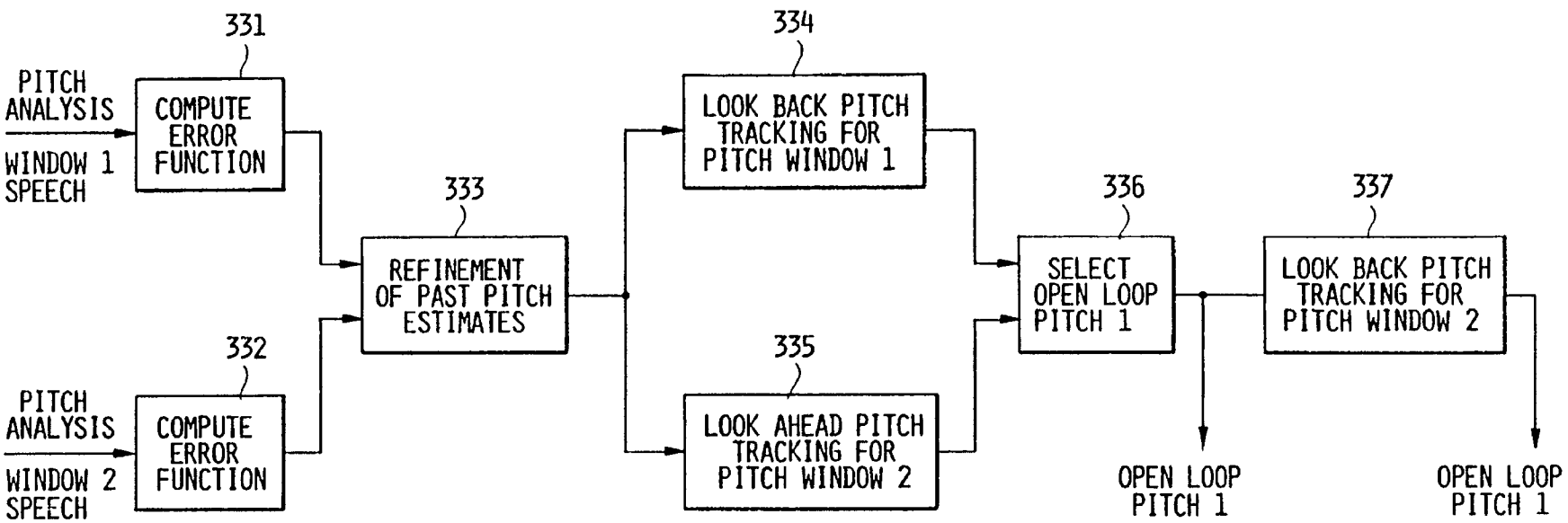
FIG. 8 is a block diagram showing in more detail the open loop pitch estimation of the encoder shown in FIG. 3.

FIG. 8 shows the open loop pitch estimation 33 of FIG. 3 in more detail. Pitch analysis windows one and two are input to respective compute error functions 331 and 332. The outputs of these error function computations are input to a refinement of past pitch estimates 333, and the refined pitch estimates are sent to both look back and look ahead pitch tracking 334 and 335 for pitch window one. The outputs of the pitch tracking circuits are input to selector 336 which selects the open loop pitch one as the first output. The selected open loop pitch one is also input to a look back pitch tracking circuit for pitch window two which outputs the open loop pitch two.

Figure 9:
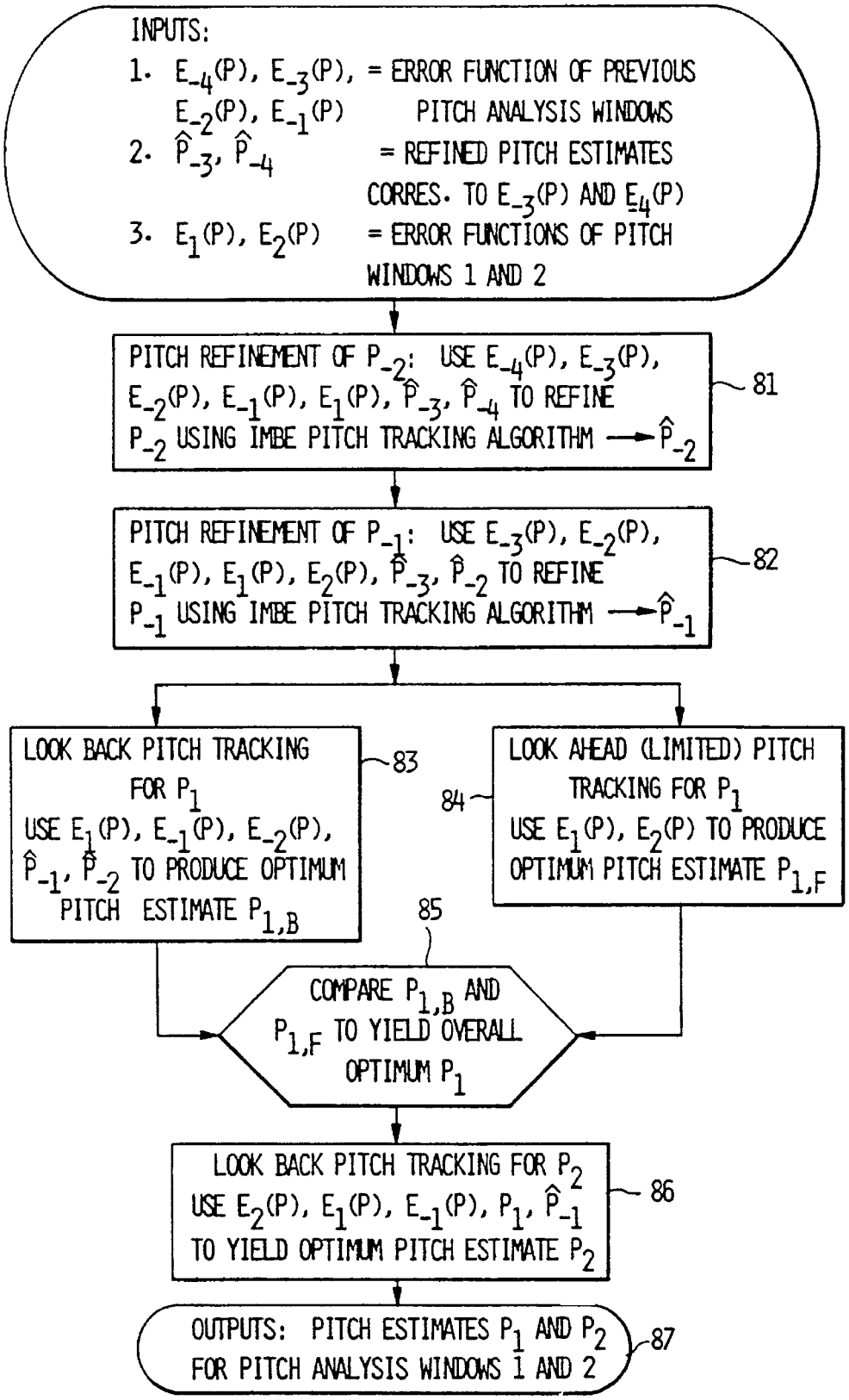
FIG. 9 is a flowchart illustrating the operation of the modified pitch tracking algorithm implemented by the open loop pitch estimation shown in FIG. 8.

FIG. 9 shows the modified pitch tracking algorithm implemented by the pitch estimation circuitry of FIG. 8. The modified pitch estimation algorithm employs the same error function as in the FIG. 7 algorithm in each pitch analysis window, but the pitch tracking scheme is altered. Prior to pitch tracking for either the first or second pitch analysis window, the previous two pitch estimates of the two previous pitch analysis windows are refined in function modules 81 and 82, respectively, with both look-back pitch tracking and look-ahead pitch tracking using the error functions of the current two pitch analysis windows. This is followed by look-back pitch tracking in function module 83 for the first pitch analysis window using the refined pitch estimates and error functions of the two previous pitch analysis windows. Look-ahead pitch tracking for the first pitch analysis window in function module 84 is limited to using the error function of the second pitch analysis window. The two estimates are compared in decision module 85 to yield an overall best pitch estimate for the first pitch analysis window. For the second pitch analysis window, look-back pitch tracking is carried out in function module 86 as well as the pitch estimate of the first patch analysis window and its error function. No look-ahead pitch tracking is used for this second pitch analysis window with the result that the look-back pitch estimate is taken to be the overall best pitch estimate at output 87.

Figure 10:
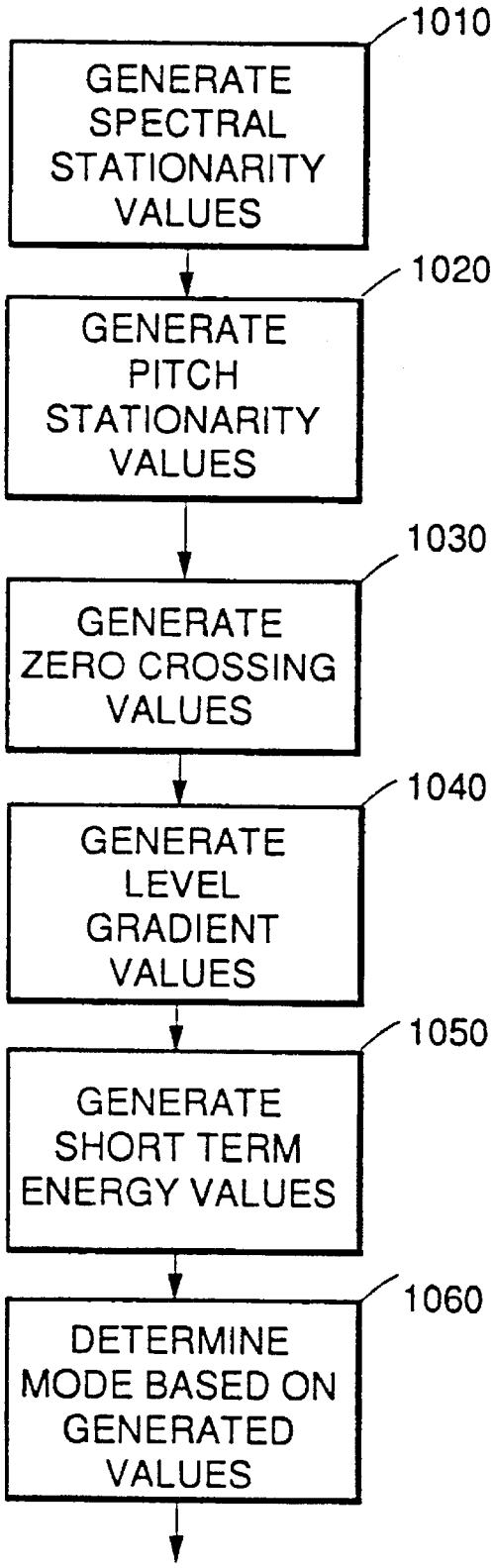
FIG. 10 is a flowchart showing the processing performed by the mode determination module shown in FIG. 3.

FIG. 10 shows the mode determination processing performed by mode selector 34. Depending on spectral stationarity, pitch stationarity, short term energy, short term level gradient, and zero crossing rate of each 40 ms. frame, mode selector 34 classifies each frame into one of three modes: voiced and stationary mode (Mode A), unvoiced or transient mode (Mode B), and background noise mode (Mode C). More specifically, mode selector 34 generates two logical values, each indicating spectral stationarity or similarity of spectral content between the currently processed frame and the previous frame (Step 1010). Mode selector 34 generates two logical values indicating pitch stationarity, similarity of fundamental frequencies, between the currently processed frame and the previous frame (Step 1020). Mode selector 34 generates two logical values indicating the zero crossing rate of the currently processed frame (Step 1030), a rate influenced by the higher frequency components of the frame relative to the lower frequency components of the frame. Mode selector 34 generates two logical values indicating level gradients within the currently processed frame (Step 1030). Mode selector 34 generates five logical values indicating short-term energy of the currently processed frame (Step 1050). Subsequently, mode selector 34 determines the mode of the frame to be mode A, mode B, or mode C, depending on the values generated in Steps 1010–1050 (Step 1060).

Figure 11:
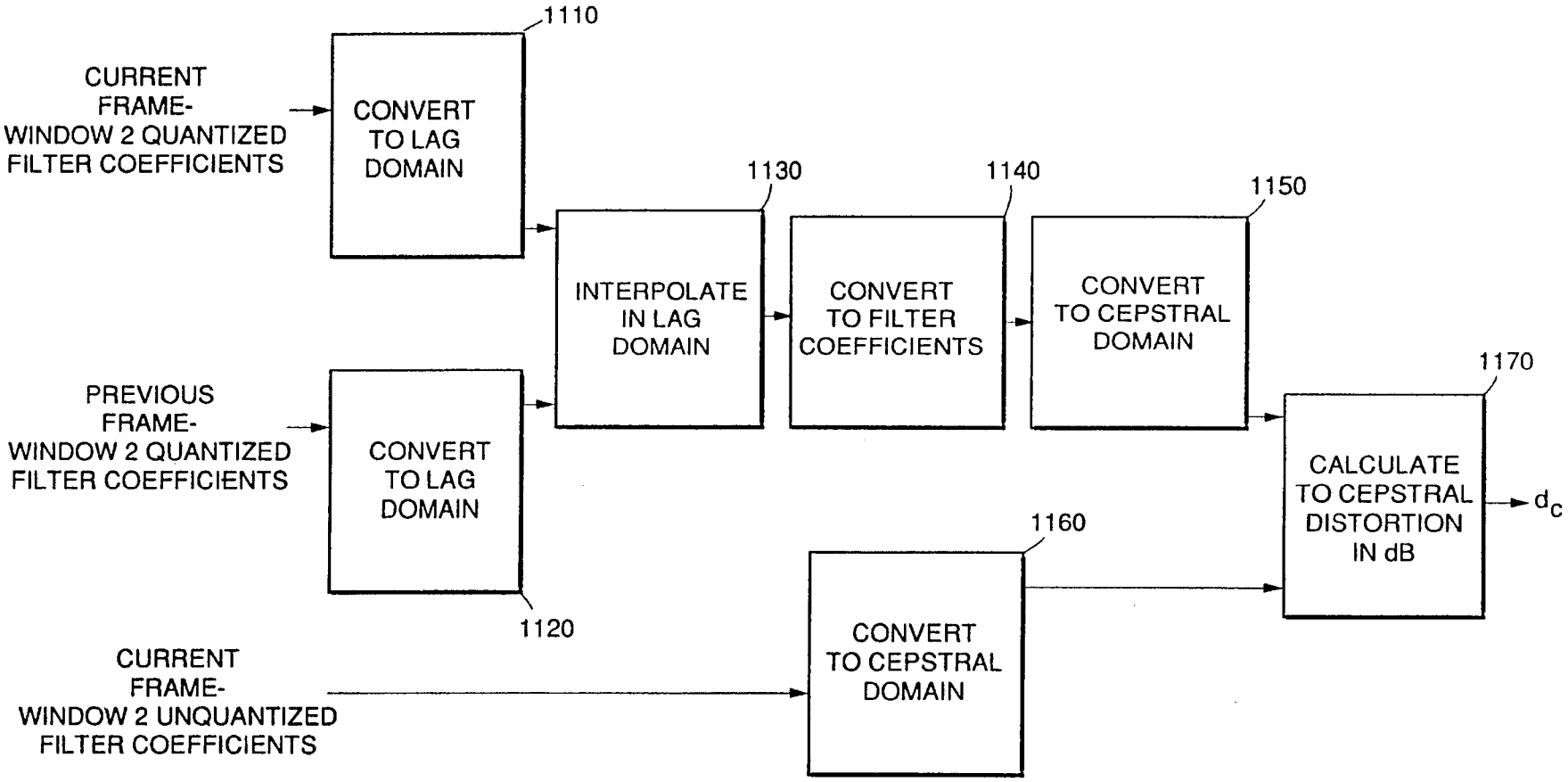
FIG. 11 is a dataflow diagram showing a part of the processing of a step of determining spectral stationarity values shown in FIG. 10.

FIG. 11 is a block diagram showing a processing of Step 1010 of FIG. 10 in more detail. The processing of FIG. 11 determines a cepstral distortion in dB. Module 1110 converts the quantized filter coefficients of window 2 of the current frame into the lag domain, and module 1120 converts the quantized filter coefficients of window 2 of the previous frame into the lag domain. Module 1130 interpolates the outputs of modules 1110 and 1120, and module 1140 converts the output of module 1130 back into falter coefficience. Module 1150 converts the output from module 1140 into the cepstral domain, and module 1160 converts the unquantized filter coefficients from window 1 of the current frame into the cepstral domain. Module 1170 generates the cepstral distortion $d_c$ from the outputs of 1150 and 1160.

Figure 12:
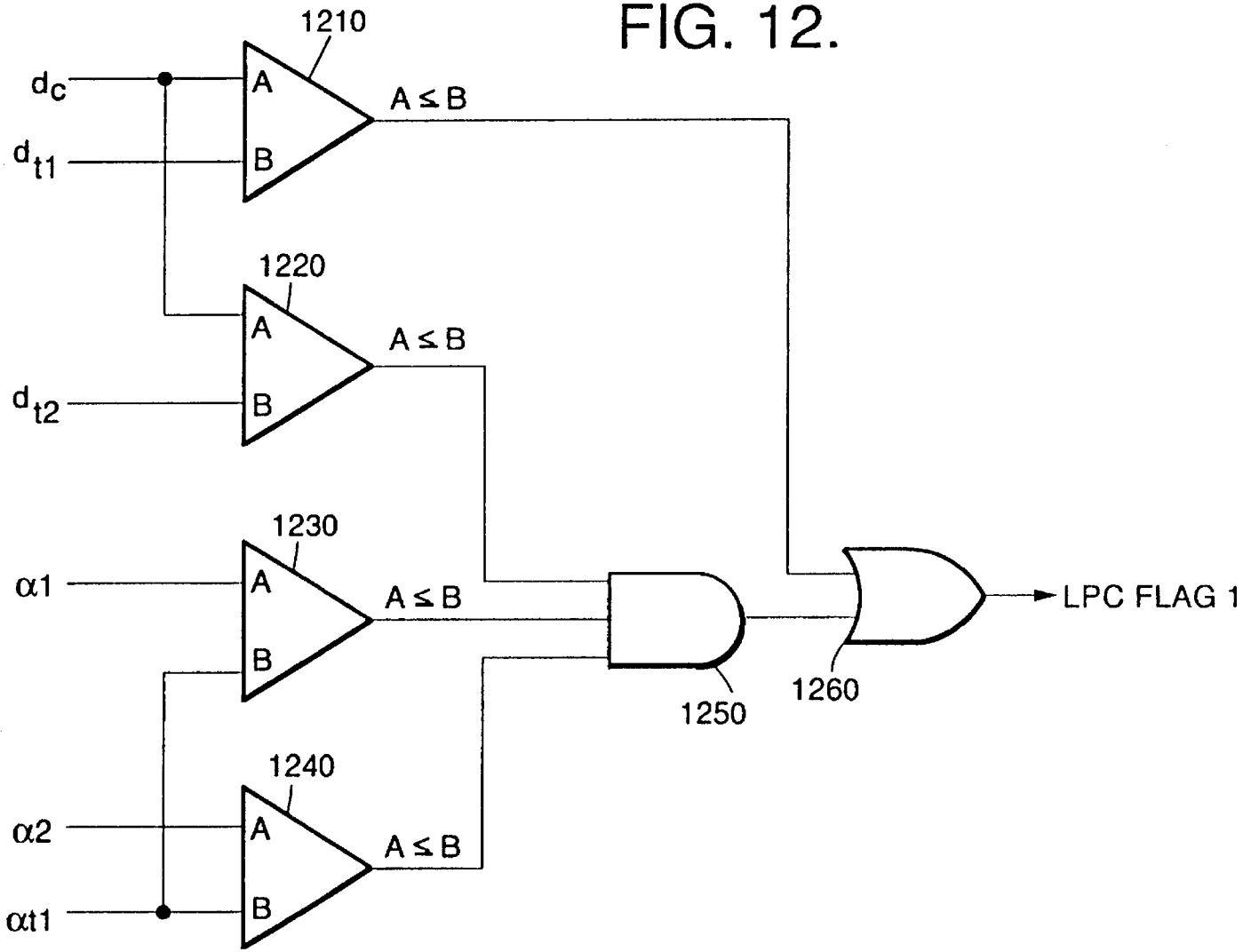
FIG. 12 is a dataflow diagram showing another part of the processing of the step of determining spectral stationarity values.

FIG. 12 shows generation of spectral stationarity value LPCFLAG1, which is a relatively strong indicator of spectral stationarity for the frame. Mode selector 34 generates LPCFLAG1 using a combination of two techniques for measuring spectral stationarity. The first technique compares the cepstral distortion $d_c$ using comparators 1210 and 1220. In FIG. 12, the $d_{t1}$ threshold input to comparator 1210 is −8.0 and the $d_{t2}$ threshold input to comparator 1220 is −6.0.

The second technique is based on the residual energy after LPC analysis, expressed as a fraction of the LPC analysis speech buffer spectral energy. This residual energy is a by-product of LPC analysis, as described above. The α1 input to comparator 1230 is the residual energy for the falter coefficients of window 1 and the α2 input to comparator 1240 is the residual energy of the filter coefficients of window 2. The αt1 input to comparators 1230 and 1240 is a threshold equal to 0.25.

Figure 13:
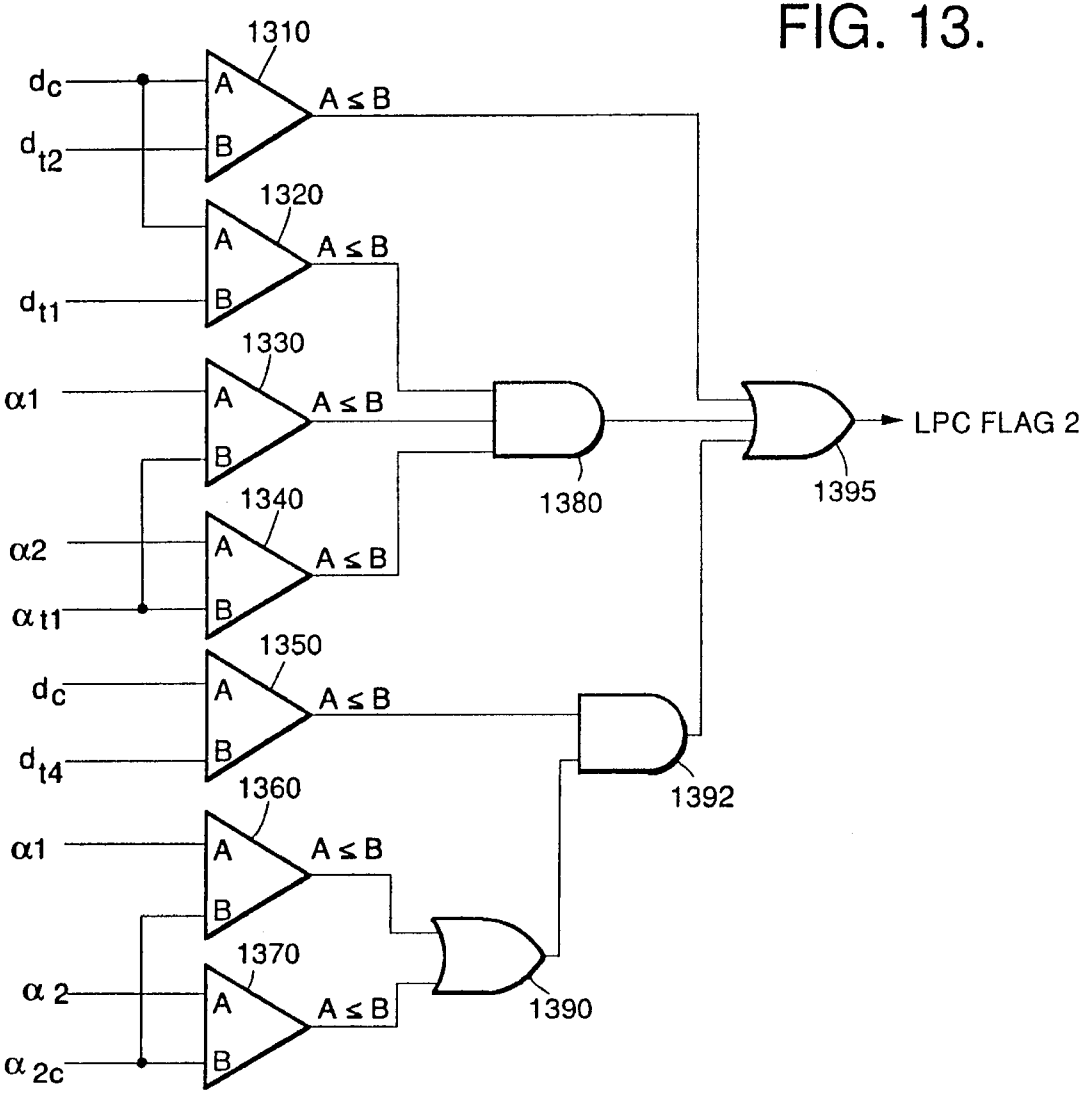
FIG. 13 is a dataflow diagram showing another part of the processing of the step of determining spectral stationarity values.

FIG. 13 shows dataflow within mode selector 34 for a generation of spectral stationarity value flag LPCFLAG2, which is a relatively week indicator of spectral stationarity. The processing shown in FIG. 13 is similar to that shown in FIG. 12, except that LPCFLAG2 is based on a relatively relaxed set of thresholds. The $d_{t2}$ input to comparator 1310 is −6.0, the $d_{t3}$ input to comparator 1320 is −4.0, the $d_{t4}$ input to comparator 1350 is −2.0, the αt1 input to comparators 1330 and 1340 is a threshold 0.25, and the αt2 to comparators 1360 and 1370 is 0.15.

Figure 14:
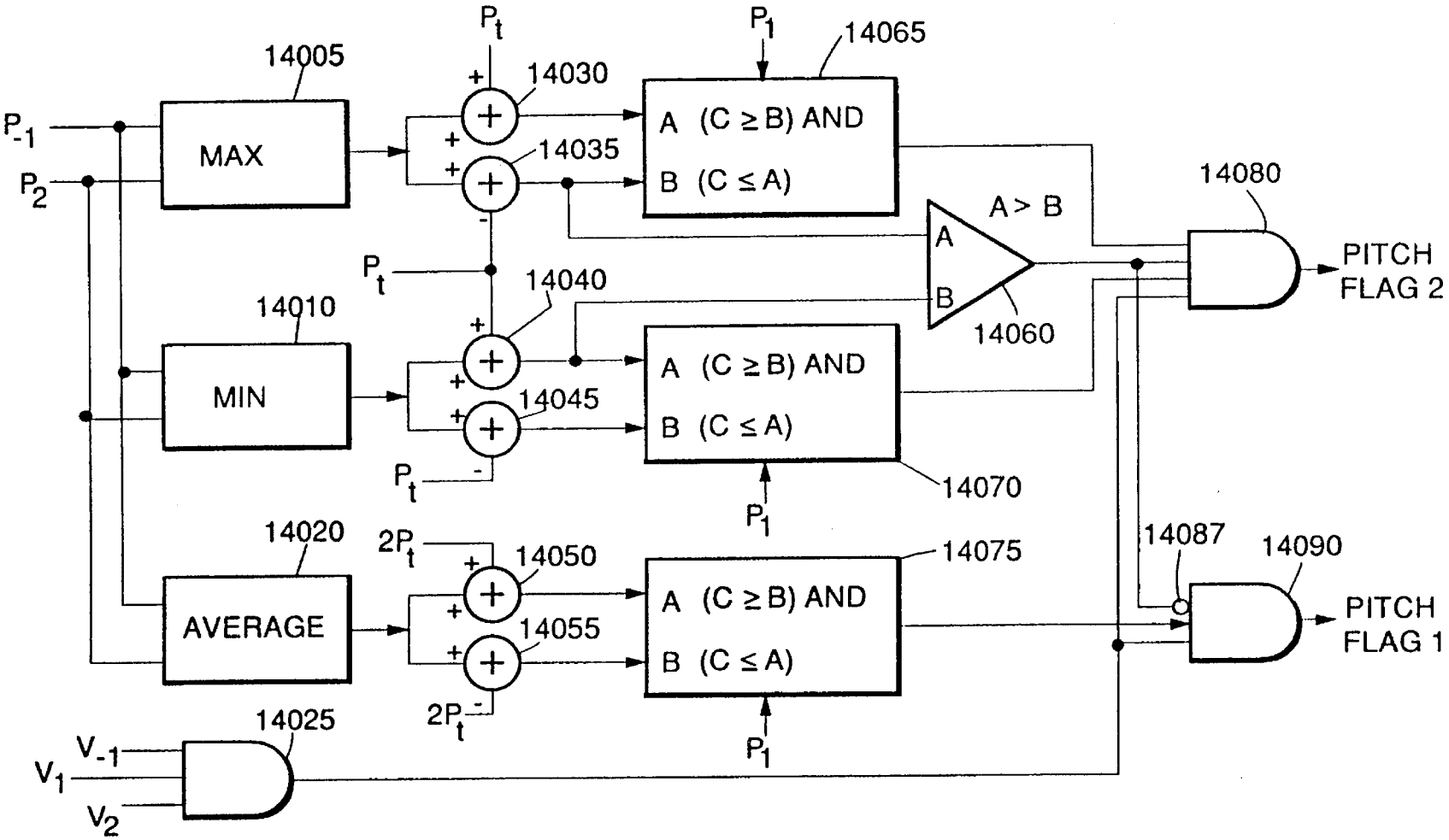
FIG. 14 is a dataflow diagram showing the processing of the step of determining pitch stationarity values shown in FIG. 10.

FIG. 14 illustrates the process by which mode selector 34 measures pitch stationarity using both the open loop pitch values of the current frame, denoted as $P_1$ for pitch window 1 and $P_2$ for pitch window 2, and the open loop pitch value of window 2 of the previous frame denoted by $P_{-1}$. A lower range of pitch values ($P_{L1}P_{U1}$) and an upper range of pitch values ($P_{L2}P_{U2}$) are:

$$P_{L1}=\text{MIN}\ (P_{-1}, P_2)-P_t$$

$$P_{U1}=\text{MIN}\ (P_{-1}, P_2)+P_t$$

$$P_{L2}=\text{MAX}\ (P_{-1}, P_2)-P_t$$

$$P_{U2}=\text{MAX}\ (P_{-1}, P_2)+P_t,$$

where $P_t$ is 8.0. If the two ranges are non-overlapping, i.e., $P_{L2}>P_{U1}$, then only a weak indicator of pitch stationarity, denoted by PITCHFLAG2, is possible end PITCHFLAG2 is set if $P_1$ lies within either the lower range ($P_{L1}$, $P_{U1}$) or upper range ($P_{L2}$, $P_{U2}$). If the two ranges are overlapping, i.e., $P_{L2}\leqq P_{U1}$, a strong indicator of pitch stationarity, denoted by PITCHFLAG1, is possible and is set if $P_1$ lies within the range ($P_L$, $P_U$), where $$P_L=(P_{-1}+P_2)/2-2P_t$$

$$P_U=(P_{-1}+P_2)/2+2P_t$$

FIG. 14 shows a dataflow for generating PITCHFLAG1 and PITCHFLAG2 within mode selector 34. Module 14005 generates an output equal to the input having the largest value, and module 14010 generates an output equal to the input having the smallest values. Module 1420 generates an output that is an average of the values of the two inputs. Modules 14030, 14035, 14040, 14045, 14050 and 14055 are adders. Modules 14080, 14025 and 14090 are AND gates. Module 14087 is an inverter. Modules 14065, 14070, and 14075 are each logic blocks generating a true output when (C>=B)&(C<=A).

The circuit of FIG. 14 also processes reliability values $V_{-1}$, $V_1$, and $V_2$, each indicating whether the values $P_{-1}$, $P_1$, and $P_2$, respectively, are reliable. Typically, these reliability values are a by-product of the pitch calculation algorithm. The circuit shown in FIG. 14 generates false values for PITCHFLAG 1 and PITCHFLAG 2 if any of these flags $V_{-1}$, $V_1$, $V_2$, are false. Processing of these reliability values is optional.

Figure 15:
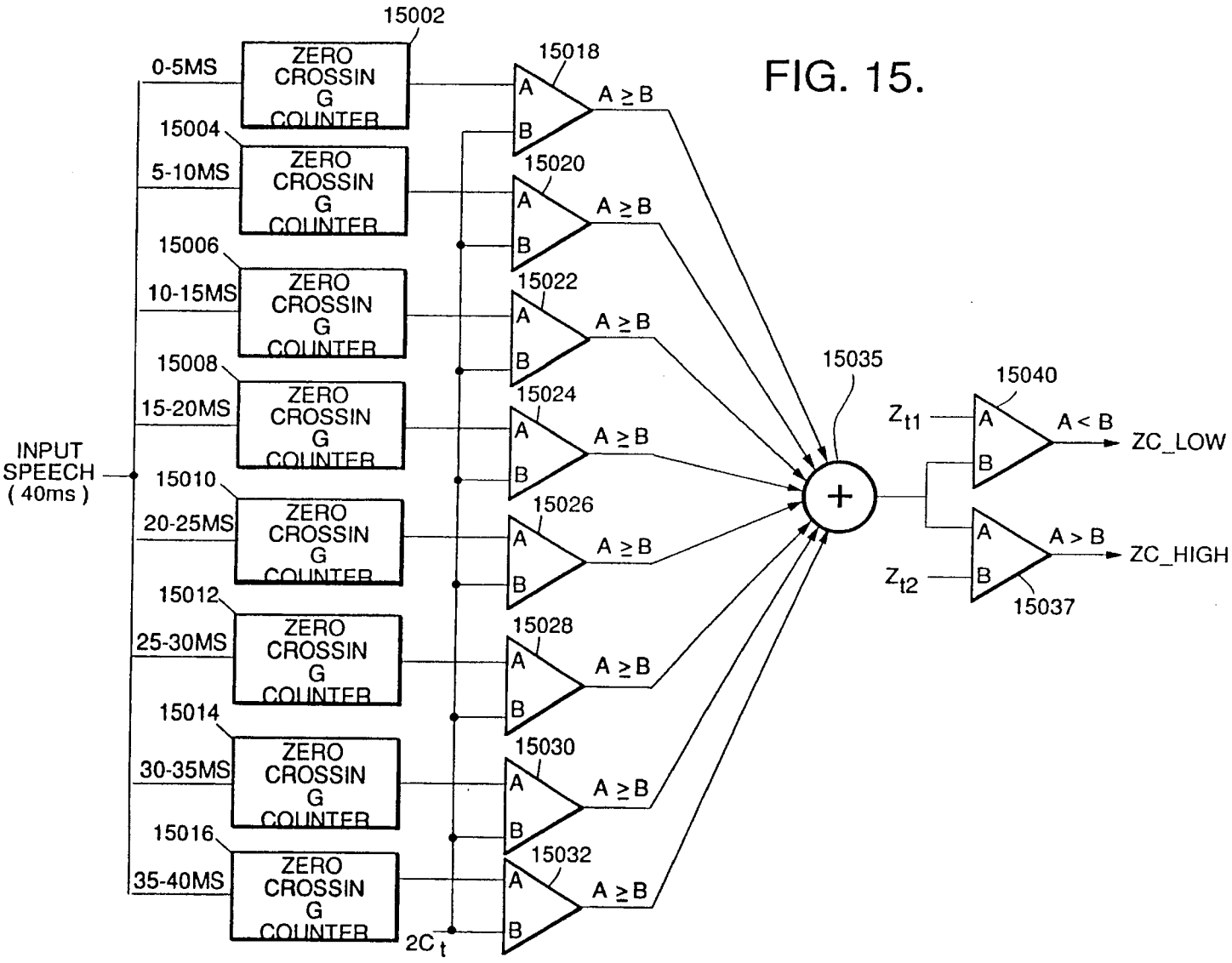
FIG. 15 is a dataflow diagram showing the processing of the step of generating zero crossing rate values shown in FIG. 10.

FIG. 15 shows dataflow within mode selector 34 for generating two logical values indicating a zero crossing rate for the frame. Modules 15002, 15004, 15006, 15008, 15010, 15012, 15014 and 15016 each count the number of zero crossings in a respective 5 millisecond subframe of the frame currently being processed. For example, module 15006 counts the number of zero crossings of the signal occurring from the time 10 millisecond from the beginning of the frame to the time 15 ms from the beginning of the frame. Comparators 15018, 15020, 15022, 14024, 15026, 15028, 15030, and 15032 in combination with adder 15035, generate a value indicating the number of 5 millisecond (MS) subframes having zero crossings of >=15. Comparator 15040 sets the flag ZC_LOW when the number of such subframes is less than 2, and the comparator 15037 sets the flag ZC_HIGH when the number of such subframes is greater than 5. The value $ZC_t$ input to comparators 15018–15032 is 15, the value $Z_{t1}$ input to comparator 15040 is 2, and the value $Z_{t2}$ input to comparator 15037 is 5.

Figure 16A:
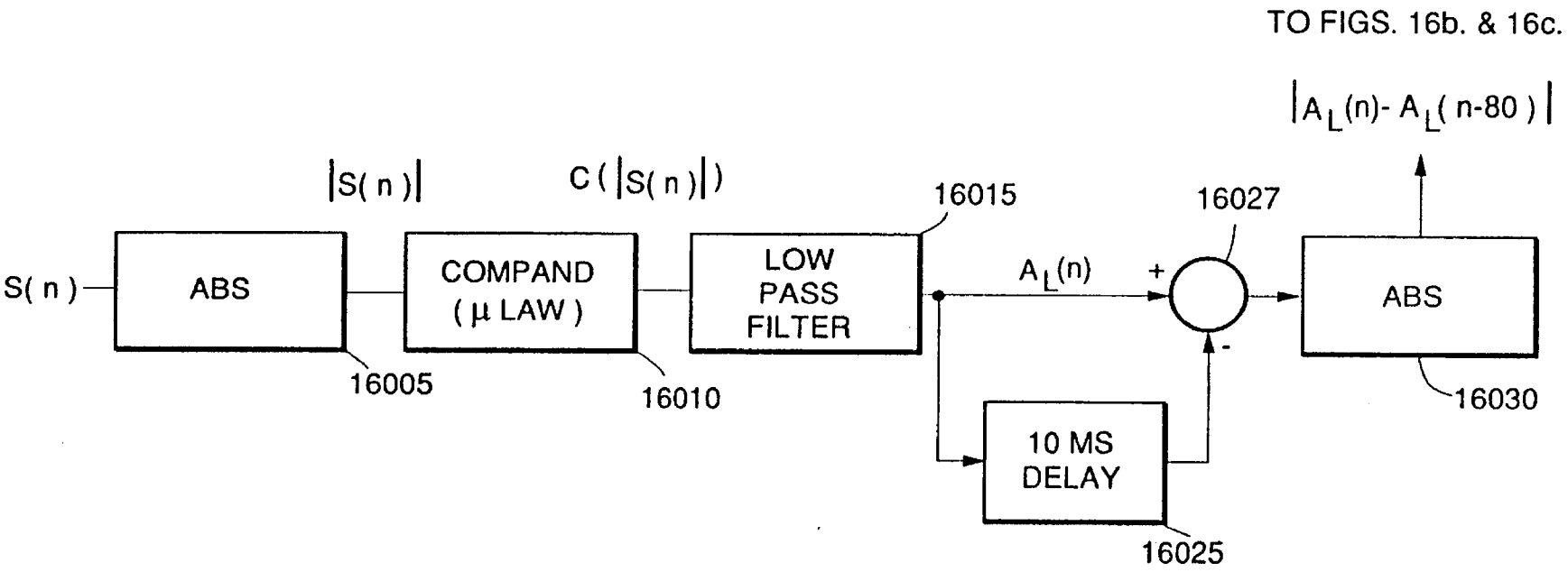
FIGS. 16A, 16B and 16C illustrate a dataflow diagram showing the processing of the step of determining level gradient values in FIG. 10.
Figure 16B:
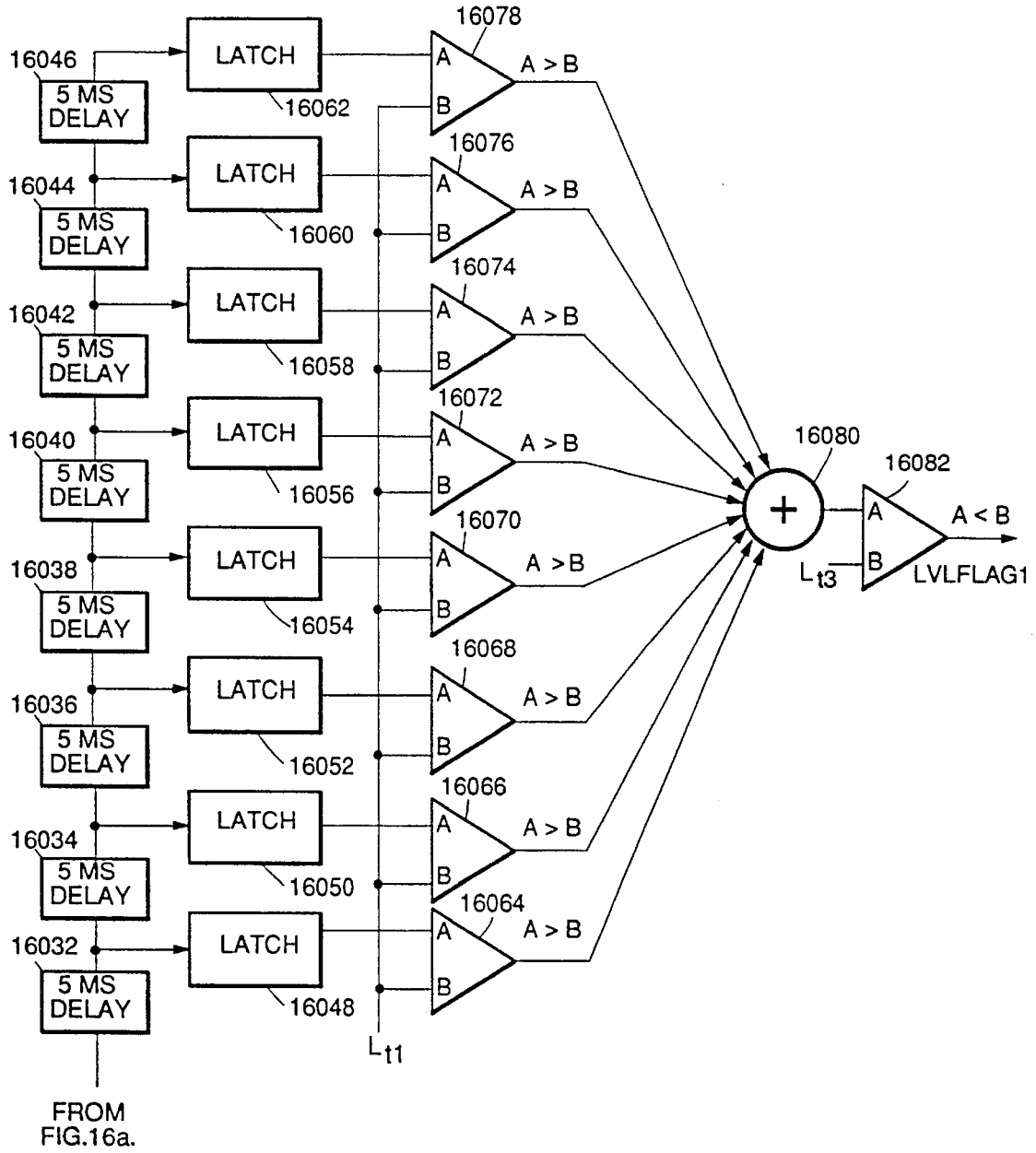
Figure 16C:
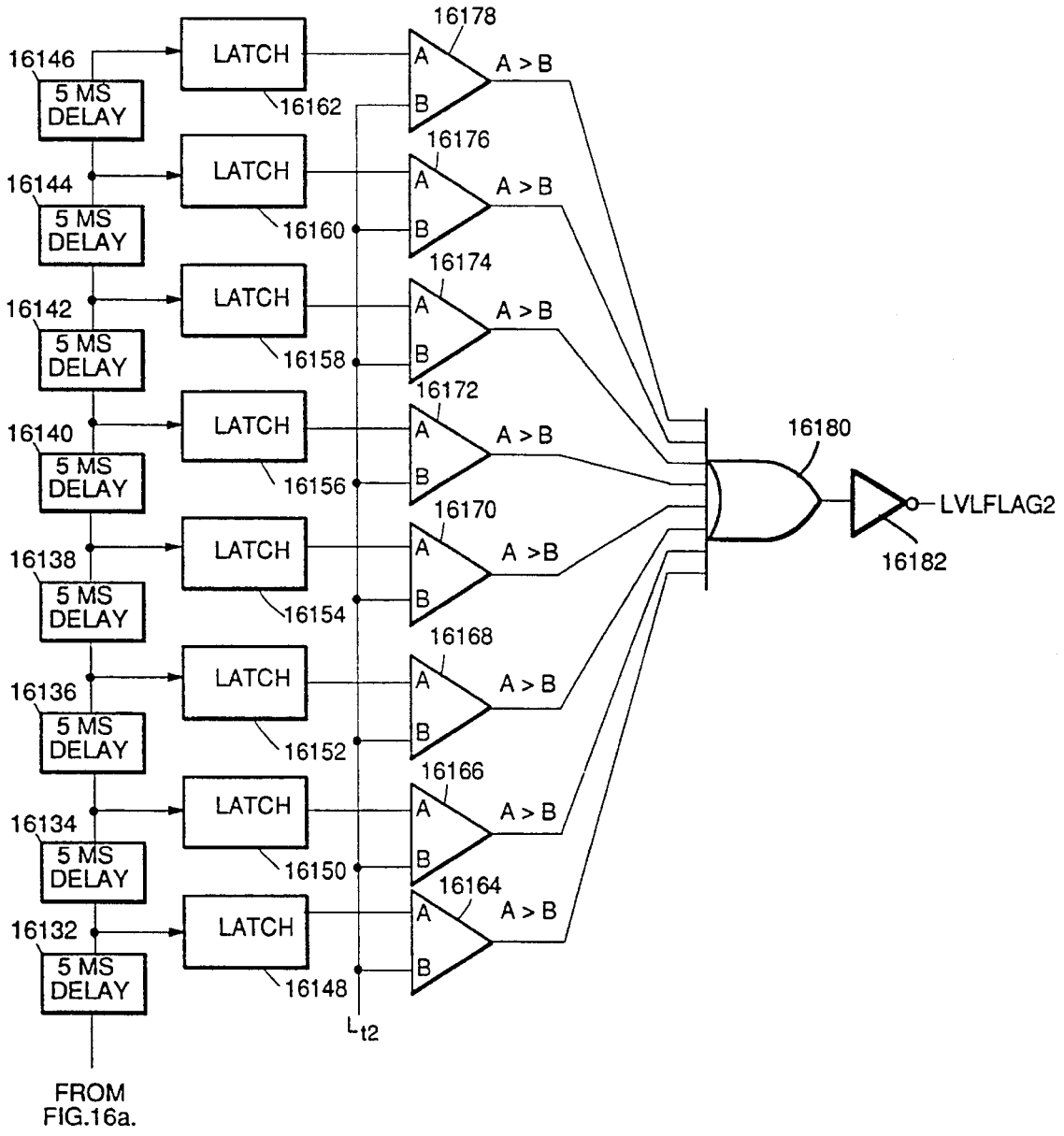

FIGS. 16A, 16B, and 16C show a data flow for generating two logical values indicative of short term level gradient. Mode selector 34 measures short term level gradient, an indication of transients within a frame, using a low-pass filtered version of the companded input signal amplitude. Module 16005 generates the absolute value of the input signal S(n), module 16010 compands its input signal, and low-pass filter 16015 generates a signal $A_L(n)$ that, at time instant n, is expressed by:

$$A_L(n)=(63/64)A_L(n-1)+(1/64)C(|s(n)|)$$

where the companding function C(.) is the μ-law function described in CCITT G.711. Delay 16025 generates an output that is a 10 ms-delayed version of its input and subtractor 16027 generates a difference between $A_L(n)$ and $A_L(N-80)$. Module 16030 generates a signal that is an absolute value of its input.

Every 5 ms, mode selector 34 compares $A_L(n)$ with that of 10 ms ago and, if the difference $|A_L(n)-A_L(n-80)|$ exceeds a fixed relaxed threshold, increments a counter. (In the preceding expression, 80 corresponds to 8 samples per MS times 10 MS). As shown in FIG. 16C, if this difference does not exceed a relatively stringent threshold ($L_{t2}$=32) for any subframe, mode selector 43 sets LVLFLAG2, weakly indicating an absence of transients. As shown in FIG. 16B, if this difference exceeds a more relaxed threshold ($L_{t1}$=10) for no more than one subframe ($L_{t3}$=2) mode selector 34 sets LVLFLAG1, strongly indicating an absence of transients.

More specifically, FIG. 16B shows delay circuits 16032–16046 that each generate a 5 ms delayed version of its input. Each of latches 16048–16062 save a signal on its input. Latches 16048–16062 are strobed at a common time, near the end of each 40 ms speech frame, so that each latch saves a portion of the frame separated by 5 ms from the portion saved by an adjacent latch. Comparators 16064–16078 each compare the output of a respective latch to the threshold $L_{t1}$ and adder 16080 sums the comparator outputs and sends the sum to comparator 16082 for comparison to the threshold $L_{t3}$.

FIG. 16C shows a circuit for generating LVLFLAG2. In FIG. 16C, delays 16132–16146 are similar to the delays shown in FIG. 16B and latches 16148–16162 are similar to the latches shown in FIG. 16B. Comparators 16164–16178 each compare an output of a respective latch to the threshold $L_{t2}$=2. Thus, OR gate 16180 generates a true output if any of the latched signal originating from module 16030 exceeds the threshold $L_{t2}$. Inverter 16182 inverts the output of OR gate 16180.

Figure 17:
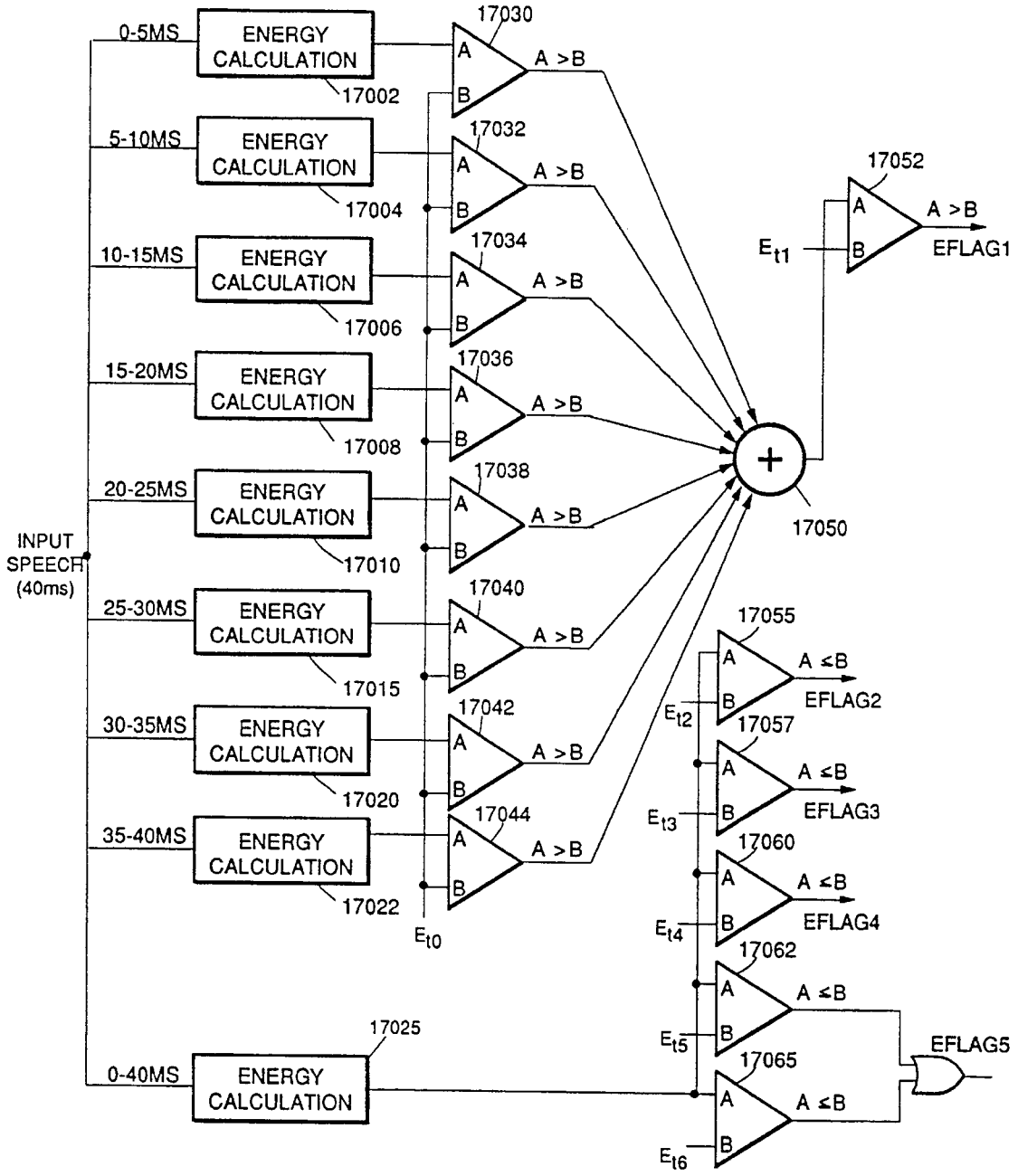
FIG. 17 is a dataflow diagram showing the processing of the step of determining short-term energy values shown in FIG. 10.

FIG. 17 shows a data flow for generating parameters indicative of short term energy. Short term energy is measured as the mean square energy (average energy per sample) on a frame basis as well as on a 5 ms basis. The short term energy is determined relative to a background energy $E_{bn}$. $E_{bn}$ is initially set to a constant $E_0=(100\times(12)^{1/2})^2$. Subsequently, when a frame is determined to be mode C, $E_{bn}$ is set equal to $(7/8)E_{bn}+(1/8)E_0$. Thus, some of the thresholds employed in the circuit of FIG. 17 are adaptive. In FIG. 17, $E_{t0}$=0.707 $E_{bn}$, $E_{t1}$=5, $E_{t2}$=2.5 $E_{bn}$, $E_{t3}$=1.8 $E_{bn}$, $E_{t4}=E_{bn}$, $E_{t5}$=0.707 $E_{bn}$, and $E_{t6}$=16.0.

The short term energy on a 5 ms basis provides an indication of presence of speech throughout the frame using a single flag EFLAG1, which is generated by testing the short term energy on a 5 ms basis against a threshold, incrementing a counter whenever the threshold is exceeded, and testing the counter's final value against a fixed threshold. Comparing the short term energy on a frame basis to various thresholds provides indication of absence of speech throughout the frame in the form of several flags with varying degrees of confidence. These flags are denoted as EFLAG2, EFLAG3, EFLAG4, and EFLAG5.

FIG. 17 shows dataflow within mode selector 34 for generating these flags. Modules 17002, 17004, 17006, 17008, 17010, 17015, 17020, and 17022 each count the energy in a respective 5 MS subframe of the frame currently being processed. Comparators 17030, 17032, 17034, 17036, 17038, 17040, 17042, and 17044, in combination with adder 17050, count the number of subframes having an energy exceeding $E_{t0}$=0.707 $E_{bn}$.

Figure 18A:
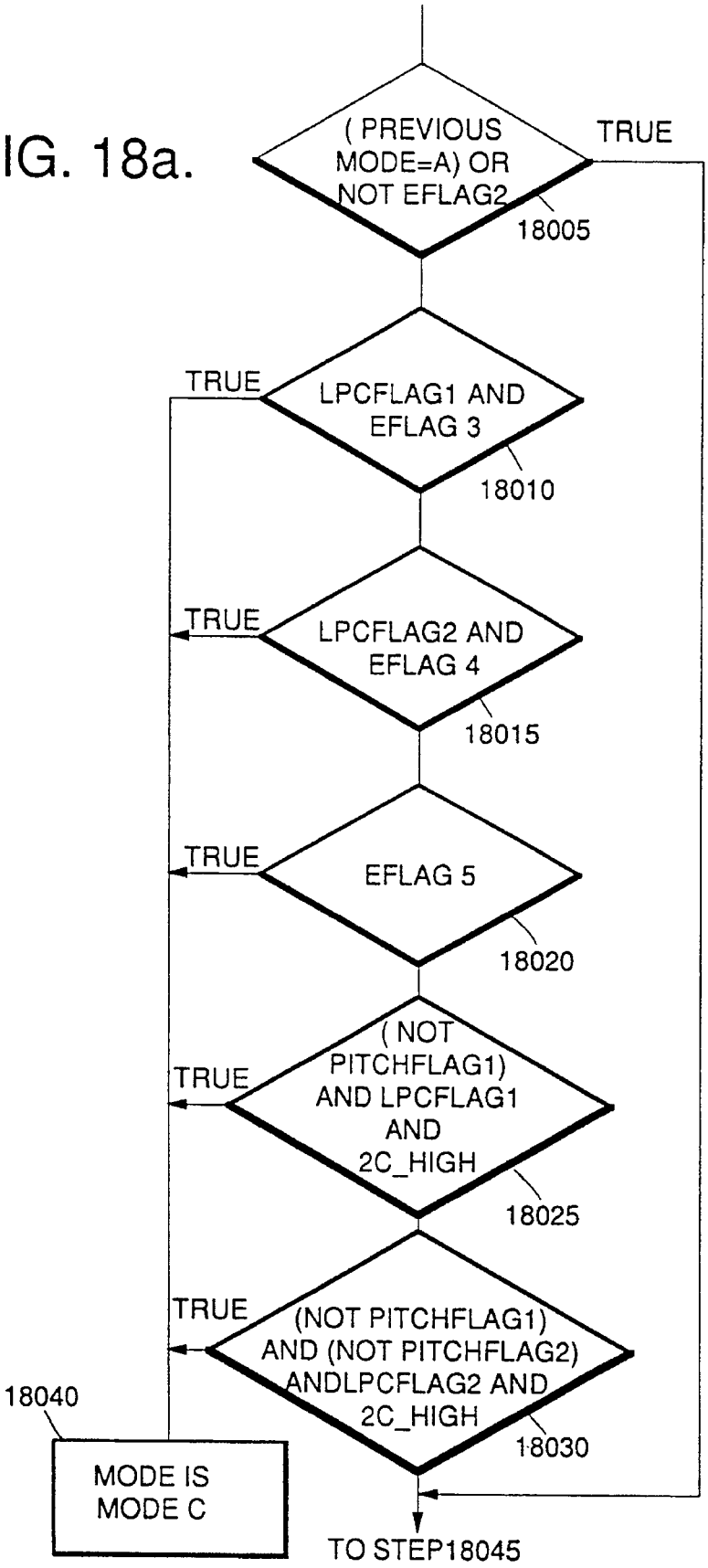
FIGS. 18A, 18B and 18C are a flowchart of determining the mode based on the generated values as shown in FIG. 10.
Figure 18B:
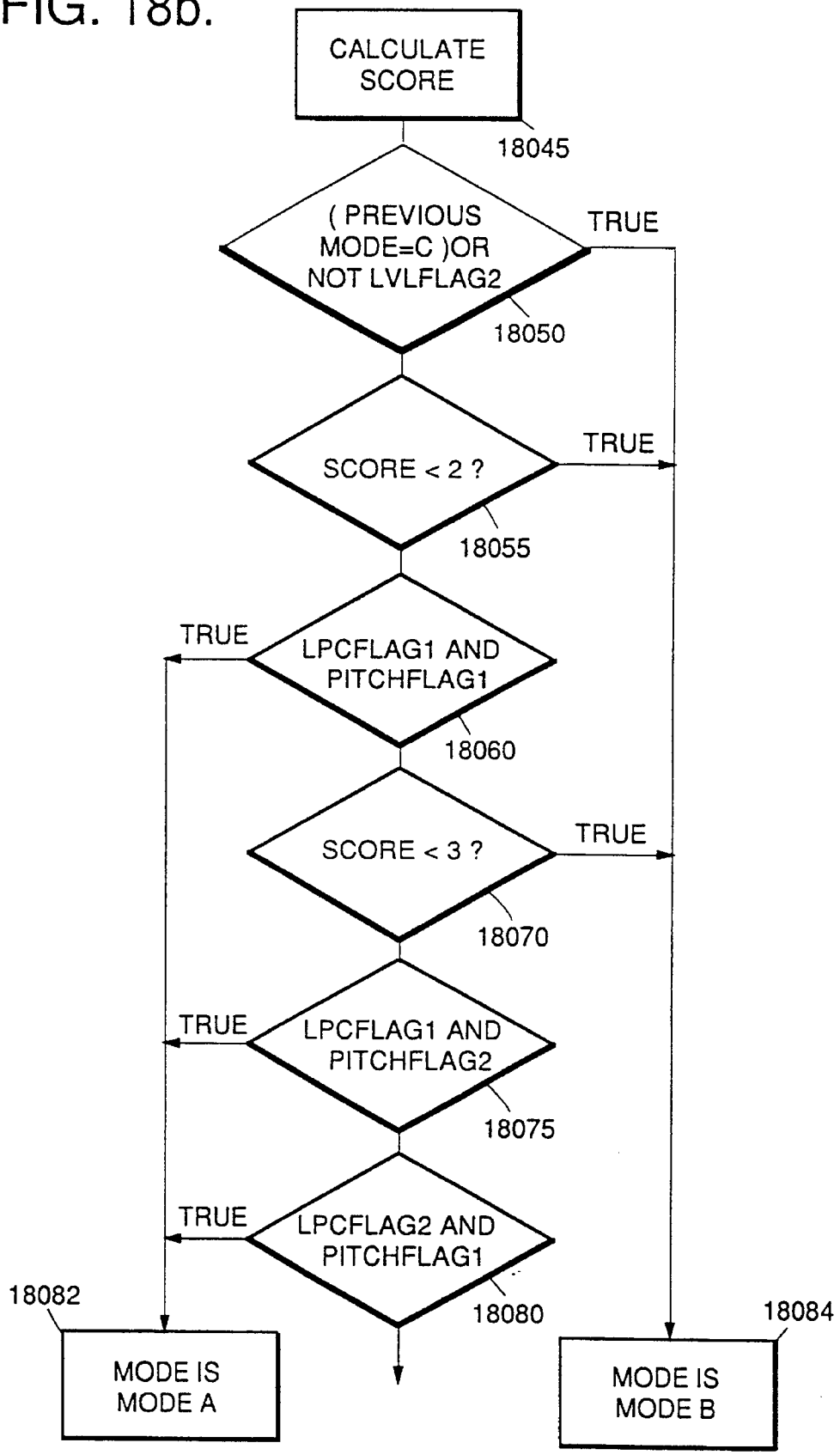
Figure 18C:
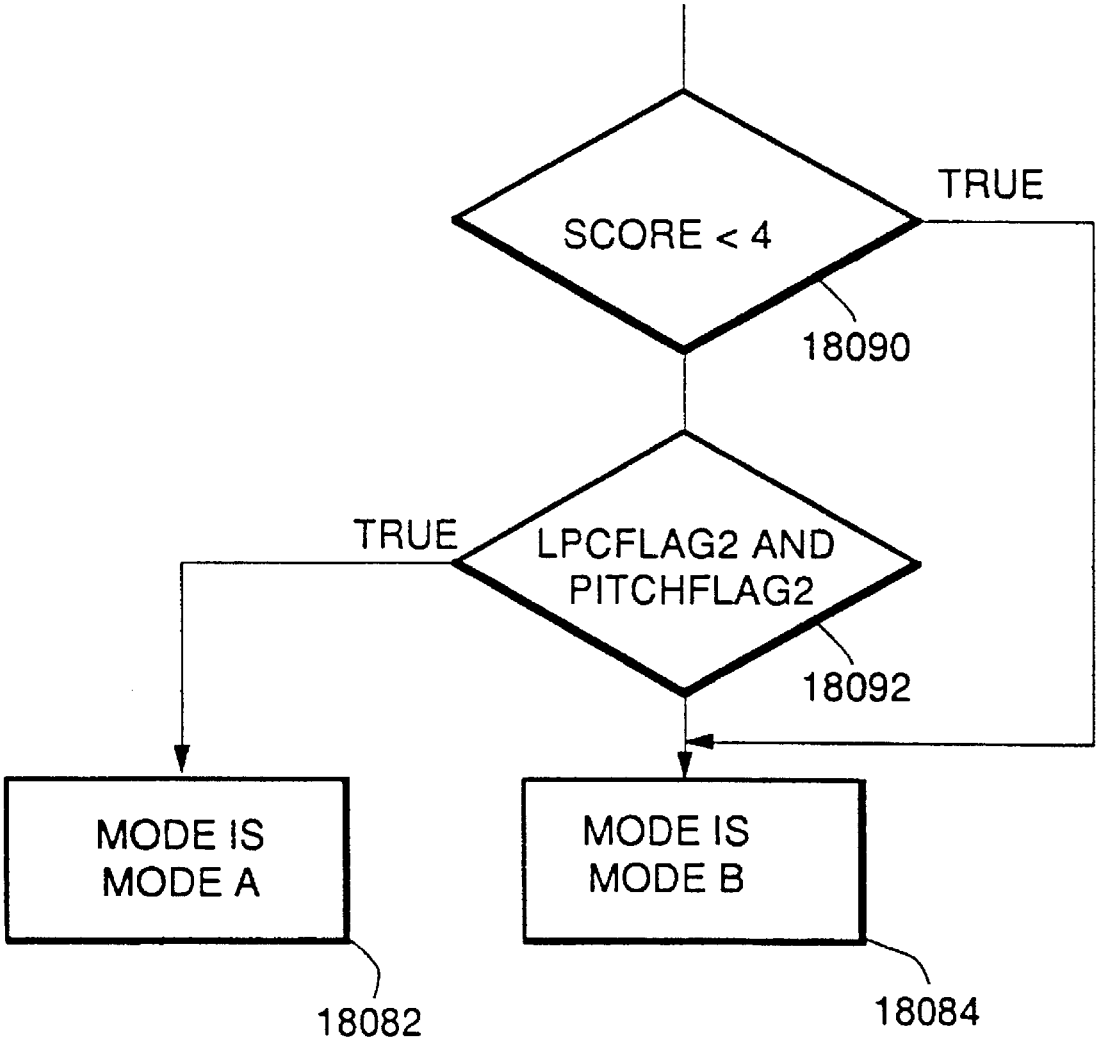
Figure 19:
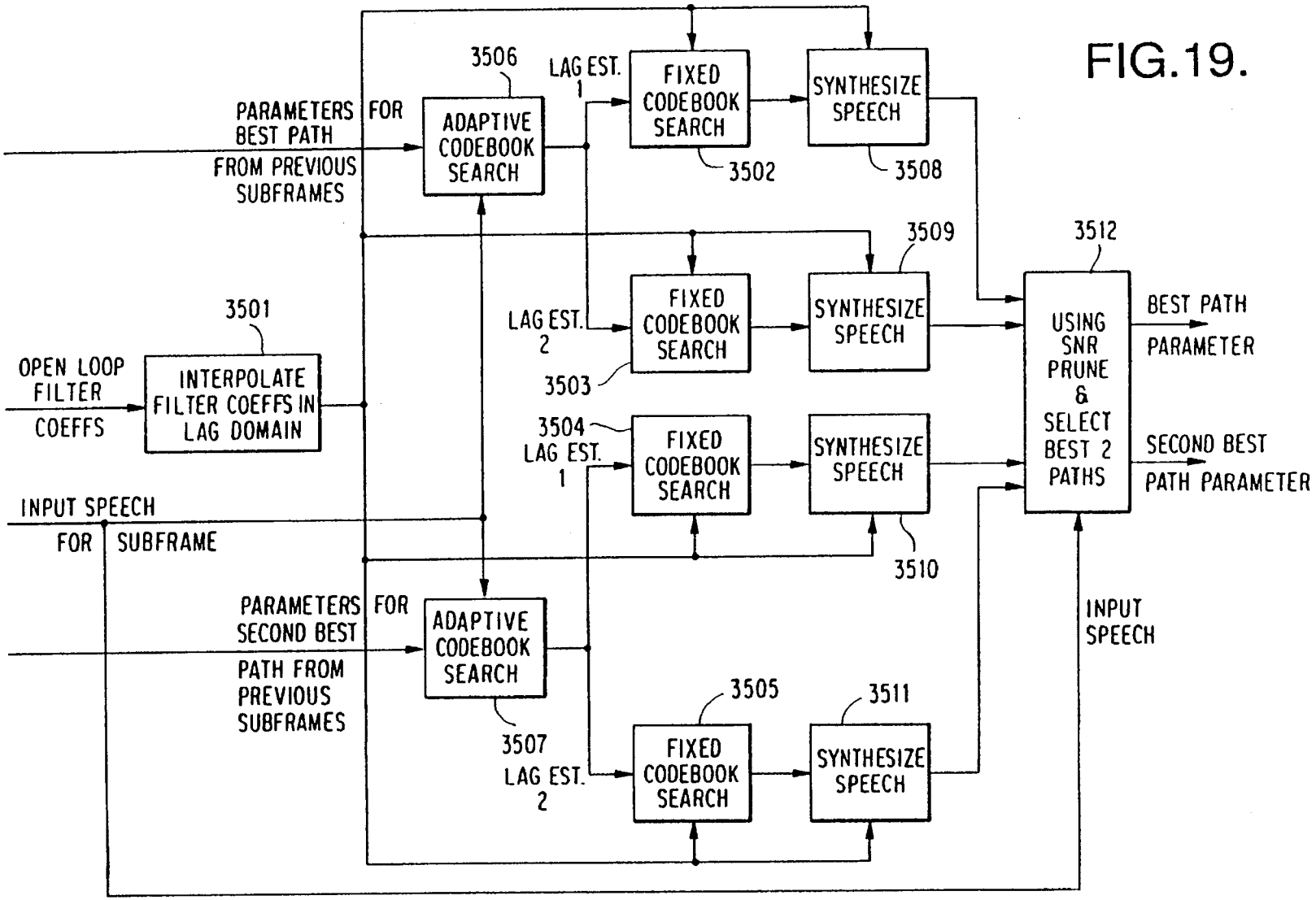
FIG. 19 is a block diagram showing in more detail the implementation of the excitation modeling circuitry of the encoder shown in FIG. 3.

FIGS. 18A, 18B, and 18C show the processing of step 1060. Mode selector 34 first classifies the frame as background noise (mode C) or speech (modes A or B). Mode C tends to be characterized by low energy, relatively high spectral stationarity between the current frame and the previous frame, a relative absence of pitch stationarity between the current frame and the previous frame, and a high zero crossing rate. Background noise (mode C) is declared either on the basis of the short term energy flag EFLAG5 alone or by combining short term energy flags EFLAG4, EFLAG3, and EFLAG2 with other flags indicating high zero crossing rate, absence of pitch, absence of transients, etc.

More specifically, if the mode of the previous frame was A or if EFLAG2 is not true, processing proceeds to step 18045 (step 18005). Step 18005 ensures that the current frame will not be mode C if the previous frame was mode A. The current frame is mode C if (LPCFLAG1 and EFLAG3) is true or (LPCFLAG2 and EFLAG4) is true or EFLAG5 is true (steps 18010, 18015, and 18020). The current frame is mode C if ((not PITCHFLAG1) and LPCFLAG1 and ZC_HIGH) is true (step 18025) or ((not PITCHFLAG1) and (not PITCHFLAG2) and LPCFLAG2 and ZC_HIGH) is true (step 18030). Thus, the processing shown in FIG. 18A determines whether the frame corresponds to a first mode (Mode C), depending on whether a speech component is substantially absent from the frame.

In step 18045, a score is calculated depending on the mode of the previous free. If the mode of the previous frame was mode A, the score is 1+LVFLAG1+EFLAG1+ZC_LOW. If the previous mode was mode B, the score is 0+LVFLAG1+EFLAG1+ZC_LOW. If the mode of the previous frame was mode C, the score is 2+LVFLAG1+EFLAG1+ZC_LOW.

If the mode of the previous frame was mode C or not LVLFLAG2, the mode of the current frame is mode B (step 18050). The current frame is mode A if (LPCFLAG1 & PITCHFLAG1) is true, provided the score is not less than 2 (steps 18060 and 18055). The current frame is mode A if (LPCFLAG1 and PITCHFLAG2) is true or (LPCFLAG2 and PITCHFLAG1) is true, provided score is not less than 3 (steps 18070, 18075, and 18080).

Subsequently, speech encoder 12 generates an encoded frame in accordance with one of a first coding scheme (a coding scheme for mode C), when the frame corresponds to the first mode, and an alternative coding scheme (a coding scheme for modes A or B), when the frame does not correspond to the first mode, as described in mode detail below.

For mode A, only the second set of line spectral frequency vector quantization indices need to be transmitted because the first set can be inferred at the receiver due to the slowly varying nature of the vocal tract shape. In addition, the first and second open loop patch estimates are quantized and transmitted because they are used to encode the closed loop pitch estimates in each subframe. The quantization of the second open loop pitch estimate is accomplished using a non-uniform 4-bit quantizer while the quantization of the first open loop pitch estimate is accomplished using a differential non-uniform 3-bit quantizer. Since the vector quantization indices of the LSF's for the first linear prediction analysis window are neither transmitted nor used in mode selection, they need not be calculated in mode A. This reduces the complexity of the short term predictor section of the encoder in this mode. This reduced complexity as well as the lower bit rate of the short term predictor parameters in mode A is offset by faster update of all the excitation model parameters.

For mode B, both sets of line spectral frequency vector quantization must be transmitted because of potential spectral nonstationarity. However, for the first set of line spectral frequencies we need search only 2 of the 4 classifications or categories. This is because the IRS vs. non-IRS selection varies very slowly with time. If the second set of line spectral frequencies were chosen from the "voiced IRS-filtered" category, then the first set can be expected to be from either the "voiced IRS-filtered" or "unvoiced IRS-filtered" categories. If the second set of line spectral frequencies were chosen from the "unvoiced IRS-filtered" category, then again the first set can be expected to be from either the "voiced IRS-filtered" or "unvoiced IRS-filtered" categories. If the second set of line spectral frequencies were chosen from the "voiced non-IRS-filtered" category, then the first set can be expected to be from either the "voiced non-IRS-filtered" or "unvoiced non-IRS filtered" categories. Finally, if the second set of line spectral frequencies were chosen from the "unvoiced non-IRS-filtered" category, then again the first set can be expected to be from either the "voiced non-IRS-filtered" or "unvoiced non-IRS-filtered" categories. As a result only two categories of LSF codebooks need be searched for the quantization of the first set of line spectral frequencies. Furthermore, only 25 bits are needed to encode these quantization indices instead of the 26 needed for the second set of LSF's, since the optimal category for the first set can be coded using just 1 bit. For mode B, neither of the two open loop pitch estimates are transmitted since they are not used in guiding the closed loop pitch estimates. The higher complexity involved in encoding as well as the higher bit rate of the short term predictor parameters in mode B is compensated by a slower update of all the excitation model parameters.

For mode C, only the second set of line spectral frequency vector quantization indices need to be transmitted because for human ear is not as sensitive to rapid changes in spectral shape variations for noisy inputs. Further, such rapid spectral shape variations are atypical for many kinds of background noise sources. For mode C, neither of the two open loop pitch estimates are transmitted since they are not used in guiding the closed loop pitch estimation. The lower complexity involved as well as the lower bit rate of the short term predictor parameters in mode C is compensated by a faster update of the fixed codebook gain portion of the excitation model parameters.

The gain quantization tables are tailored to each of the modes. Also in each mode, the closed loop parameters are refined using a delayed decision approach. This delayed decision is employed in such a way that the overall codec delay is not increased. Such a delayed decision approach is very effective in transition regions.

In mode A, the quantization indices corresponding to the second set of short term predictor coefficients as well as the open loop pitch estimates are transmitted. Only these quantized parameters are used in the excitation modeling. The 40-msec speech frame is divided into seven subframes. The first six are 5.75 msec in length and seventh is 5.5 msec in length. In each subframe, an interpolated set of short term predictor coefficients are used. The interpolation is done in the autocorrelation lag domain. Using this interpolated set of coefficients, a closed loop analysis by synthesis approach is used to derive the optimum pitch index, pitch gain index, fixed codebook index, and fixed codebook gain index for each subframe. The closed loop pitch index search range is centered around an interpolated trajectory of the open loop pitch estimates. The trade-off between the search range and the pitch resolution is done in a dynamic fashion depending on the closeness of the open loop pitch estimates. The fixed codebook employs zinc pulse shapes which are obtained using a weighted combination of the sinc pulse and a phase shifted version of its Hilbert transform. The fixed codebook gain is quantized in a differential manner.

The analysis by synthesis technique that is used to derive the excitation model parameters employs an interpolated set of short term predictor coefficients in each subframe. The determination of the optimal set of excitation model parameters for each subframe is determined only at the end of each 40 ms. frame because of delayed decision. In deriving the excitation model parameters, all the seven subframes are assumed to be of length 5.75 ms. or forty-six samples. However, for the last or seventh subframe, the end of subframe updates such as the adaptive codebook update and the update of the local short term predictor state variables are carried out only for a subframe length of 5.5 ms. or forty-four samples.

The short term predictor parameters or linear prediction filter parameters are interpolated from subframe to subframe. The interpolation is carried out in the autocorrelation domain. The normalized autocorrelation coefficients derived from the quantized filter coefficients for the second linear prediction analysis window are denoted as $\{\rho_{-1}(i)\}$ for the previous 40 ms. frame and by $\{\rho_2(i)\}$ for the current 40 ms. frame for $0 \leqq i \leqq 10$ with $\rho_{-1}(0)=\rho_2(0)=1.0$. Then the interpolated autocorrelation coefficients $\{\rho'_m(i)\}$ are then given by $$\rho'_m(i)=\nu_m \cdot \rho_2(i)+[1-\nu_m]\cdot\rho_{-1}(i),\ 1 \leqq m \leqq 7, 0 \leqq i \leqq 10,$$

or in vector notation $$\rho'_m=\nu_m \cdot \rho_2+[1-\nu_m]\cdot\rho_{-1},\ 1 \leqq m \leqq 7.$$

Here, $\nu_m$ is the interpolating weight for subframe m. The interpoleted lags $\{\rho'_m(i)\}$ are subsequently converted to the short term predictor filter coefficients $\{a'_m(i)\}$.

The choice of interpolating weights affects voice quality in this mode significantly. For this reason, they must be determined carefully. These interpolating weights $\nu_m$ have been determined for subframe m by minimizing the mean square error between actual short term spectral envelope $S_{m,j}(\omega)$ and the interpolated short term power spectral envelope $S'_{m,J}(\omega)$ over all speech frames J of a very large speech database. In other words, m is determined by minimizing $$E_m=\sum_J \frac{1}{2\pi}\int_{-\pi}^{\pi} |S_{m,J}(\omega)-S'_{m,J}(\omega)|^2 d\omega.$$

If the actual autocorrelation coefficients for subframe m in frame J are denoted by $\{\rho_{m,J}(k)\}$, then by definition $$S_{m,J}(W)=\sum_{-10}^{10} \rho_{m,J}(k)\, e^{-jwk}$$

$$S'_{m,J(\omega)}=\sum_{-10}^{10} \rho'_{m,J}(k)\, e^{-jwk}.$$

Substituting the above equations into the preceding equation, it can be shown that minimizing $E_m$ is equivalent to minimizing $E'_m$ where $E'_m$ is given by $$E'_m=\sum_J \sum_{k=-10}^{10} [\rho_{m,J}(k)-\rho'_{m,J}(k)]^2,$$

or in vector notation $$E'_m=\sum_J \|\rho_{m,J}-\rho'_{m,J}\|^2,$$

where $\|\cdot\|$ represents the vector norm. Substituting $\rho'_{m,J}$ into the above equation, differentiating with respect to $\nu_m$ and setting it to zero results in $$\nu_m=\frac{\left|\sum_J (X_J, Y_{m,J}\right|}{\sum_J |X_J|^2}$$

where $X_J=\rho_{2,J}-\rho_{-1,J}$ and $Y_{m,J}=\rho_{m,J}-\rho_{-1,J}$ and $<X_J Y_{m,J}>$ is the dot product between vectors $X_J$ and $Y_{m,J}$. The values of $\nu_m$ calculated by the above method using a very large speech database are further fine tuned by listening tests.

The target vector $t_{ac}$ for the adaptive codebook search is related to the speech vector s in each subframe by $s=Ht_{ac}+Z$. Here, H is the square lower triangular toeplitz matrix whose first column contains the impulse response of the interpolated short term predictor $\{a'_m(i)\}$ for the subframe m and z is the vector containing its zero input response. The target vector $t_{ac}$ is most easily calculated by subtracting the zero input response z from the speech vector s and filtering the difference by the inverse short term predictor with zero initial states.

The adaptive codebook search in adaptive codebooks 3506 and 3507 employs a spectrally weighted mean square error $\xi_i$ to measure the distance between a candidate vector $r_1$ and the target vector $t_{ac}$, as given by $$\xi_i=(t_{ac}=\mu_i r_i)^T W(t_{ac}-\mu_i r_i).$$

Here, $\mu_i$ is the associated gain and W is the spectral weighting matrix. W is a positive definite symmetric toeplitz matrix that is derived from the truncated impulse response of the weighted short term predictor with filter coefficients $\{a'_m(i)\gamma^i\}$. The weighting factor $\gamma$ is 0.8. Substituting for the optimum $\mu_i$ in the above expression, the distortion term can be rewritten as $$\epsilon_i = t_{ac}^T W t_{ac} - \frac{[\rho_i]^2}{e_i},$$

where $\rho_i$ is the correlation term $t_{ac}^T W r_i$ and $e_i$ is the energy term $r_i^T W r_i$. Only those candidates are considered that have a positive correlation. The best candidate vectors are the ones that have positive correlations and the highest values of $$\frac{[\rho_i]^2}{e_i}$$

The candidate vector $r_i$ corresponds to different pitch delays. These pitch delays in samples lie in the range [20,146]. Fractional pitch delays are possible but the fractional part f is restricted to be either 0.00, 0.25, 0.50, or 0.75. The candidate vector corresponding to an integer delay L is simply read from the adaptive codebook, which is a collection of the past excitation samples. For a mixed (integer plus fraction) delay L+f, the portion of the adaptive codebook centered around the section corresponding to the integer delay L is filtered by a polyphase filter corresponding to fraction f. Incomplete candidate vectors corresponding to low delay values less than a subframe length are completed in the same manner as suggested by J. Campbell et. al., supra. The polyphase filter coefficients are derived from a prototype low pass filter designed to have good passband as well as good stopband characteristics. Each polyphase filter has 8 taps.

The adaptive codebook search does not search all candidate vectors. For the first 3 subframes, a 5-bit search range is determined by the second quantized open loop pitch estimate $P'_{-1}$ of the previous 40 ms frame and the first quantized open loop pitch estimate $P'_1$ of the current 40 ms frame. If the previous mode were B, then the value of $P'_{-1}$ is taken to be the last subframe pitch delay in the previous frame. For the last 4 subframes, this 5-bit search range is determined by the second quantized open loop pitch estimate $P'_2$ of the current 40 ms frame and the first quantized open loop pitch estimate $P'_1$ of the current 40 ms frame. For the first 3 subframes, this 5-bit search range is split into 2 4-bit ranges with each range centered around $P'_{-1}$ and $P'_1$. If these two 4-bit ranges overlap, then a single 5-bit range is used which is centered around $\{P'_{-1}+P'_1\}/2$. Similarly, for the last 4 subframes, this 5-bit search range is split into 2 4-bit ranges with each range centered around $P'_1$ and $P'_2$. If these two r-bit ranges overlap, then a single 5-bit range is used which is centered around $\{P'_1+P'_2\}/2$.

The search range selection also determines what fractional resolution is needed for the closed loop pitch. This desired fractional resolution is determined directly from the quantized open loop pitch estimates $P'_{-1}$ and $P'_1$ for the first 3 subframes and from $P'_1$ and $P'_2$ for the last 4 subframes. If the two determining open loop pitch estimates are within 4 integer delays of each other resulting in a single 5-bit search range, only 8 integer delays centered around the mid-point are searched but fractional pitch f portion can assume values of 0.00, 0.25, 0.50, or 0.75 and are therefore also searched. Thus 3 bits are used to encode the integer portion while 2 bits are used to encode the fractional portion of the closed loop pitch. If the two determining open loop pitch estimates are within 8 integer delays of each other resulting in a single 5-bit search range, only 16 integer delays centered around the mid-point are searched but fractional pitch f portion can assume values of 0.0 or 0.5 and are therefore also searched. Thus 4 bits are used to encode the integer portion while 1 bit is used to encode the fractional portion of the closed loop pitch. If the two determining open loop pitch estimates are more than 8 integer delays apart, only integer delays, i.e., f=0.0 only, are searched in either the single 5-bit search range or the 2 4-bit search ranges determined. Thus all 5 bits are spent in encoding the integer portion of the closed loop pitch.

The search complexity may be reduced in the case of fractional pitch delays by first searching for the optimum integer delay and searching for the optimum fractional pitch delay only in its neighborhood. One of the 5-bit indices, the all zero index, is reserved for the all zero adaptive codebook vector. This is accommodated by trimming the 5-bit or 32 pitch delay search range to a 31 pitch delay search range. As indicated before, the search is restricted to only positive correlations and the all zero index is chosen if no such positive correlation is found. The adaptive codebook gain is determined after search by quantizing the ratio of the optimum correlation to the optimum energy using a non-uniform 3-bit quantizer. This 3-bit quantizer only has positive gain values in it since only positive gains are possible.

Since delayed decision is employed, the adaptive codebook search produces the two best pitch delay or lag candidates in all subframes. Furthermore, for subframes two to six, this has to be repeated for the two best target vectors produced by the two best sets of excitation model parameters derived for the previous subframes in the current frame. This results in two best lag candidates and the associated two adaptive codebook gains for subframe one and in four best lag candidates and the associated four adaptive codebook gains for subframes two to six at the end of the search process. In each case, the target vector for the fixed codebook is derived by subtracting the scaled adaptive codebook vector from the target for the adaptive codebook search, i.e., $t_{sc}=t_{ac}-\mu_{opt}r_{opt}$, where $r_{opt}$ is the selected adaptive codebook vector and $\mu_{opt}$ is the associated adaptive codebook gain.

In mode A, the fixed codebook consists of general excitation pulse shapes constructed from the discrete sinc and cosc functions. The sinc function is defined as $$\mathrm{sinc}(n) = \frac{\sin(\pi n)}{\pi n}, \; n = 0$$

$$\mathrm{sinc}(0) = 1 \; n = 0$$

and the cosc function is defined as $$\mathrm{cosc}(n) = \frac{1-\cos(\pi n)}{\pi n}, \; n = 0$$

-continued $$\text{cosc}(0) = 0 \; n = 0$$

With these definitions in mind, the generalized excitation pulse shapes are constructed as follows:

$$z_1(n)=A\ sinc(n)+B\ cosc(n+1)$$

$$z_{-1}(n)=A\ sinc(n)-B\ cosc(n-1)$$

The weights A and B are chosen to be 0.866 and 0.5 respectively. With the sinc and cosc functions time aligned, they correspond to what is known as zinc basis functions $z_0(n)$. Informal listening tests show that time-shifted pulse shapes improve voice quality of the synthesized speech.

The fixed codebook for mode A consists of 2 parts each having 45 vectors. The first part consists of the pulse shape $z_{-1}(n-45)$ and is 90 samples long. The $i^{th}$ vector is simply the vector that starts from the $i^{th}$ codebook entry. The second part consists of the pulse shape $z_1(n-45)$ and is 90 samples long. Here again, the $i^{th}$ vector is simply the vector that starts from the $i^{th}$ codebook entry. Both codebooks are further trimmed to reduce all small values especially near the beginning and end of both codebooks to zero. In addition, we note that every even sample in either codebook is identical to zero by definition. All this contributes to making the codebooks very sparse. In addition, we note that both codebooks are overlapping with adjacent vectors having all but one entry in common.

The overlapping nature and the sparsity of the codebooks are exploited in the codebook search which uses the same distortion measure as in the adaptive codebook search. This measure calculates the distance between the fixed codebook target vector $t_{sc}$ and every candidate fixed codebook vector $c_i$ as $$E_i=(t_{sc}-\lambda_i c_i)^T W(t_{sc}-\lambda_i c_i)$$

Where W is the same spectral weighting matrix used in the adaptive codebook search and $\lambda_i$ is the optimum value of the gain for that $i^{th}$ codebook vector. Once the optimum vector has been selected for each codebook, the codebook gain magnitude is quantized outside the search loop by quantizing the ratio of the optimum correlation to the optimum energy by a non-uniform 4-bit quantizer in odd subframes and a 3-bit differential non-uniform quantizer in even subframes. Both quantizers have zero gain as one of their entries. The optimal distortion for each codebook is then calculated and the optimal codebook is selected.

The fixed codebook index for each subframe is in the range 0–44 if the optimal codebook is from $z_1(n-45)$ but is mapped to the range 45–89 if the optimal codebook is from $z_1(n-45)$. By combining the fixed codebook indices of two consecutive frames I and J as 90I+J, we can encode the resulting index using 13 bits. This is done for subframes 1 and 2, 3 and 4, 5 and 6. For subframe 7, the fixed codebook index is simply encoded using 7 bits. The fixed codebook gain sign is encoded using 1 bit in all 7 subframes. The fixed codebook gain magnitude is encoded using 4 bits in subframes 1, 3, 5, 7 and using 3 bits in subframes 2, 4, 6.

Due to delayed decision, there are two target vectors $t_{sc}$ for the fixed codebook search in the first subframe corresponding to the two best lag candidates and their corresponding gains provided by the closed loop adaptive codebook search. For subframes two seven, there are four target vectors corresponding to the two best sets of excitation model parameters determined for the previous subframes so far and to the two best lag candidates and their gains provided by the adaptive codebook search in the current subframe. The fixed codebook search is therefore carried out two times in subframe one and four times in subframes two to six. But the complexity does not increase in a proportionate manner because in each subframe, the energy terms $c^T_i Wc_i$ are the same. It is only the correlation terms $t^T_{sc} Wc_i$ that are different in each of the two searches for subframe one and in each of the four searches in subframes two to seven.

Delayed decision search helps to smooth the pitch and gain contours in a CELP coder. Delayed decision is employed in this invention in such a way that the overall codec delay is not increased. Thus, in every subframe, the closed loop pitch search produces the M best estimates. For each of these M best estimates and N best previous subframe parameters, MN optimum pitch gain indices, fixed codebook indices, fixed codebook gain indices, and fixed codebook gain signs are derived. At the end of the subframe, these MN solutions are pruned to the L best using cumulative SNR for the current 40 ms. frame as the criteria. For the first subframe, M=2, N=1 and L=2 are used. For the last subframe, M=2, N=2 and L=1 are used. For all other subframes, M=2, N=2 and L=2 are used. The delayed decision approach is particularly effective in the transition of voiced to unvoiced and unvoiced to voiced regions. This delayed decision approach results in N times the complexity of the closed loop pitch search but much less than MN times the complexity of the fixed codebook search in each subframe. This is because only the correlation terms need to be calculated MN times for the fixed codebook in each subframe but the energy terms need to be calculated only once.

Figure 20:
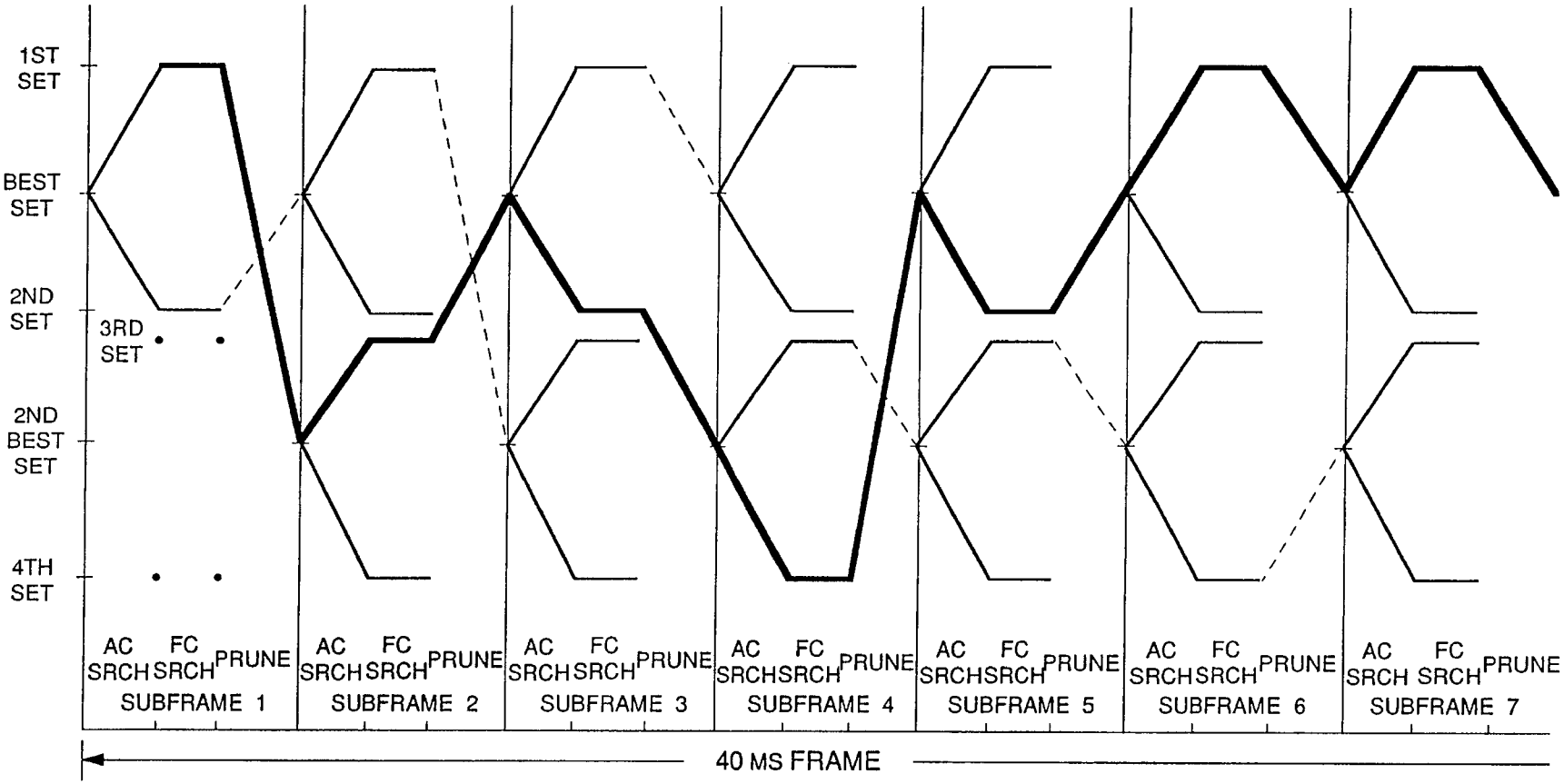
FIG. 20 is a diagram illustrating a processing of the encoder show in FIG. 3.

The optimal parameters for each subframe are determined only at the end of the 40 ms. frame using traceback. The pruning of MN solutions to L solutions is stored for each subframe to enable the trace back. An example of how traceback is accomplished is shown in FIG. 20. The dark, thick line indicates the optimal path obtained by traceback after the last subframe.

In mode B, the quantization indices of both sets of short term predictor parameters are transmitted but not the open loop pitch estimates. The 40-msec speech frame is divided into five subframes, each 8 msec long. As in mode A, an interpolated set of filter coefficients is used to derive the pitch index, pitch gain index, fixed codebook index, and fixed codebook gain index in a closed loop analysis by synthesis fashion. The closed loop pitch search is unrestricted in its range, and only integer pitch delays are searched. The fixed codebook is a multi-innovation codebook with zinc pulse sections as well as Hadamard sections. The zinc pulse sections are well suited for transient segments while the Hadamard sections are better suited for unvoiced segments. The fixed codebook search procedure is modified to take advantage of this.

The higher complexity involved as well as the higher bit rate of the short term predictor parameters in mode B is compensated by a slower update of the excitation model parameters.

For mode B, the 40 ms. speech frame is divided into five subframes. Each subframe is of length 8 ms. or sixty-four samples. The excitation model parameters in each subframe are the adaptive codebook index, the adaptive codebook gain, the fixed codebook index, and the fixed codebook gain. There is no fixed codebook gain sign since it is always positive. Best estimates of these parameters are determined using an analysis by synthesis method in each subframe. The overall best estimate is determined at the end of the 40 ms. frame using a delayed decision approach similar to mode A.

The short term predictor parameters or linear prediction filter parameters are interpolated from subframe to subframe in the autocorrelation lag domain. The normalized autocorrelation lags derived from the quantized filter coefficients for the second linear prediction analysis window are denoted as $\{\rho'_{-1}(i)\}$ for the previous 40 ms. frame. The corresponding lags for the first and second linear prediction analysis windows for the current 40 ms. frame are denoted by $\{\rho_1(i)\}$ and $\{\rho_2(i)\}$, respectively. The normalization ensures that $\rho_{-1}(0)=\rho_1(0)=\rho_2(0)=1.0$. The interpolated autocorrelation lags $\{\rho'_m(i)\}$ are given by $$\rho'_m(i)=\alpha_m\cdot\rho_{-1}(i)+\beta_m\cdot\rho_1(i)+[1-\alpha_m-\beta_m]\cdot\rho_2(i),\ 1<=m<=5, 0<=m10,$$

or in vector notation $$\rho'_m=\alpha_m\cdot\rho_{-1}+\beta_m\cdot\rho_1+[1-\alpha_m-\beta]\cdot\rho_2\ \ 1<=m<=5.$$

Here, $\alpha_m$ and $\beta_m$ are the interpolating weights for subframe m. The interpolation lags $\{\rho'_m(i)\}$ are subsequently converted to the short term predictor filter coefficients $\{a'_m(i)\}$.

The choice of interpolating weights is not as critical in this mode as it is in mode A. Nevertheless, they have been determined using the same objective criteria as in mode A and fine tuning them by listening tests. The values of $\alpha_m$ and $\beta_m$ which minimize the objective criteria $E_m$ can be shown to be $$\alpha_m=\frac{Y_mC-X_mB}{C^2-AB}$$

$$\beta_m=\frac{X_mC-Y_mA}{C^2-AB}$$

where $$A=\sum_J\|\rho_{-1,J}-\rho_{2,J}\|^2$$

$$B=\sum_J\|\rho_{-1,J}-\rho_{2,J}\|^2$$

$$C=\sum_J<\rho_{-1,J}-\rho_{2,J},\rho_{1,J}-\rho_{2,J}>$$

$$X_m=\sum_J<\rho_{-1,J}-\rho_{2,J},\rho_{m,J}-\rho_{2,J}>$$

$$Y_m=\sum_J<\rho_{m,J}-\rho_{2,J},\rho_{1,J}-\rho_{2,J}>$$

As before, $\rho_{-1,J}$ denotes the autocorrelation lag vector derived from the quantized filter coefficients of the second linear prediction analysis window of frame J-1, $\rho_{1,J}$ denotes the autocorrelation lag vector derived from the quantized filter coefficients of the first linear prediction analysis window of frame J, $\rho_{2,J}$ denotes the autocorrelation lag vector derived from the quantized filter coefficients of the second linear prediction analysis window of frame J, and $\rho_{m,J}$ denotes the actual autocorrelation lag vector derived from the speech samples in subframe m of frame J.

The adaptive codebook search in mode B is similar to that in mode A in that the target vector for the search is derived in the same manner and the distortion measure used in the search is the same. However, there are some differences. Only all integer pitch delays in the range [20,146] are searched and no fractional pitch delays are searched. As in mode A, only positive correlations are considered in the search and the all zero index corresponding to an all zero vector is assigned if no positive correlations are found. The optimal adaptive codebook index is encoded using 7 bits. The adaptive codebook gain, which is guaranteed to be positive, is quantized outside the search loop using a 3-bit non-uniform quantizer. This quantizer is different from that used in mode A.

As in mode A, delayed decision is employed so that adaptive codebook search produces the two best pitch delay candidates in all subframes. In addition, in subframes two to five, this has to be repeated for the two best target vectors produced by the two best sets of excitation model parameters derived for the previous subframes resulting in 4 sets of adaptive codebook indices and associated gains at the end of the subframe. In each case, the target vector for the fixed codebook search is derived by subtracting the scaled adaptive codebook vector from the target of the adaptive codebook vector.

The fixed codebook in mode B is a 9-bit multi-innovation codebook with three sections. The first is a Hadamard vector sum section and the second and third sections are related to generalized excitation pulse shapes $z_{-1}(n)$ and $z_1(n)$ respectively. These pulse shapes have been defined earlier. The first section of this codebook and the associated search procedure is based on the publication by D. Lin "Ultra-Fast CELP Coding Using Multi-Codebook Innovations", ICASSP92. We note that in this section, there are 256 innovation vectors and the search procedure guarantees a positive gain. The second and third sections have 64 innovation vectors each and their search procedure can produce both positive as well as negative gains.

One component of the multi-innovation codebook is the deterministic vector-sum code constructed from the Hadamard matrix $H_m$. The code vector of the vector-sum code as used in this invention is expressed as $$u_i=\sum_{m=1}^{4}\theta_{im}v_m(n),\ 0\leqq i\leqq 15,$$

where the basis vectors $v_m(n)$ are obtained from the rows of the Hadamard-Sylvester matrix and $\theta_{im}=\pm 1$. The basis vectors are selected based on a sequency partition of the Hadamard matrix. The code vectors of the Hadamard vector-sum codebooks are values and binary valued code sequences. Compared to previously considered algebraic codes, the Hadamard vector-sum codes are constructed to possess more ideal frequency and phase characteristics. This is due to the basis vector partition scheme used in this invention for the Hadamard matrix which can be interpreted as uniform sampling of the sequency ordered Hadamard matrix row vectors. In contrast, non-uniform sampling methods have produced inferior results.

The second section of the multi-innovation codebook consists of the pulse shape $z_{-1}(n-63)$ and is 127 samples long. The $i^{th}$ vector of this section is simply the vector that starts from the $i^{th}$ entry of this section. The third section consists of the pulse shape $z_{-1}(n-63)$ and is 127 samples long. Here again, the $i^{th}$ vector of this section is simply the vector that starts from the $i^{th}$ entry of this section. Both the second and third sections enjoy the advantages of an overlapping nature and sparsity that can be exploited by the search procedure Just as in the fixed codebook in mode A. As indicated earlier, the search procedure is not restricted to positive correlations and therefore both positive as well as negative gains can result in the second and third sections.

Once the optimum vector has been selected for each section, the codebook gain magnitude is quantized outside the search loop by quantizing the ratio of the optimum correlation to the optimum energy by a non-uniform 4-bit quantizer in all subframes. This quantizer is different for the first section while the second and third sections use a common quantizer. All quantizers have zero gain as one of their entries. The optimal distortion for each section is then calculated and the optimal section is finally selected.

The fixed codebook index for each subframe is in the range 0–255 if the optimal codebook vector is from the Hadamard section. If it is from the $z_{-1}(n-63)$ section and the gain sign is positive, it is mapped to the range 256–319. If is from the $z_{-1}(n-63)$ section and the gain sign is negative, it is mapped to the range 320–383. If it is from the $z_1(n-63)$ and the gain sign is positive, it is mapped to the range 384–447. If it is from the $z_1(n-63)$ section and the gain sign is negative, it is mapped to the range 448–511. The resulting index can be encoded using 9 bits. The fixed codebook gain magnitude is encoded using 4 bits in all subframes.

For mode C, the 40 ms frame is divided into five subframes as in mode B. Each subframe is of length 8 ms or 64 samples. The excitation model parameters in each subframe are the adaptive codebook index, the adaptive codebook gain, the fixed codebook index, and 2 fixed codebook gains, one fixed codebook gain being associated with each half of the subframe. Both are guaranteed to be positive and therefore there is no sign information associated with them. As in both modes A and B, best estimates of these parameters are determined using an analysis by synthesis method in each subframe. The overall best estimate is determined at the end of the 40 ms frame using a delayed decision method identical to that used in modes A and B.

The short term predictor parameters or linear prediction filter parameters are interpolated from subframe to subframe in the autocorrelation lag domain in exactly the same manner as in mode B. However, the interpolating weights $\alpha_m$ and $\beta_m$ are different from that used in mode B. They are obtained by using the procedure described for mode B but using various background noise sources as training material.

The adaptive codebook search in mode C is identical to that in mode B except that both positive as well as negative correlations are allowed in the search. The optimal adaptive codebook index is encoded using 7 bits. The adaptive codebook gain, which could be either positive or negative, is quantized outside the search loop using a 3-bit non-uniform quantizer. This quantizer is different from that used in either mode A or mode B in that it has a more restricted range and may have negative values as well. By allowing both positive as well as negative correlations in the search loop and by having a quantizer with a restricted dynamic range, periodic artifacts in the synthesized background noise due to the adaptive codebook are reduced considerably. In fact, the adaptive codebook now behaves more like another fixed codebook.

As in mode A and mode B, delayed decision is employed and the adaptive codebook search produces the two best candidates in all subframes. In addition, in subframes two to five, this has to be repeated for the two target vectors produced by the two best sets of excitation model parameters derived for the previous subframes resulting in 4 sets of adaptive codebook indices and associated gains at the end of the subframe. In each case, the target vector for the fixed codebook search is derived by subtracting the scaled adaptive codebook vector from the target of the adaptive codebook vector.

The fixed codebook in mode C is a 8-bit multi-innovation codebook and is identical to the Hadamard vector sum section in the mode B fixed multi-innovation codebook. The same search procedure described in the publication by D. Lin "Ultra-Fast CELP Coding Using Multi-Codebook Innovations", ICASSP92, is used here. There are 256 codebook vectors and the search procedure guarantees a positive gain. The fixed codebook index is encoded using 8 bits.

Once the optimum codebook vector has been selected, the optimum correlation and optimum energy are calculated for the first half of the subfree as well as the second half of the subframe separately. The ratio of the correlation to the energy in both halves are quantized independently using a 5-bit non-uniform quantizer that has zero gain as one of its entries. The use of 2 gains per subframe ensures a smoother reproduction of the background noise.

Due to the delayed decision, there are two sets of optimum fixed codebook indices and gains in subframe one and four sets in subframes two to five. The delayed decision approach in mode C is identical to that used in other modes A and B. The optimal parameters for each subframe are determined at the end of the 40 ms frame using an identical traceback procedure.

Figure 24:
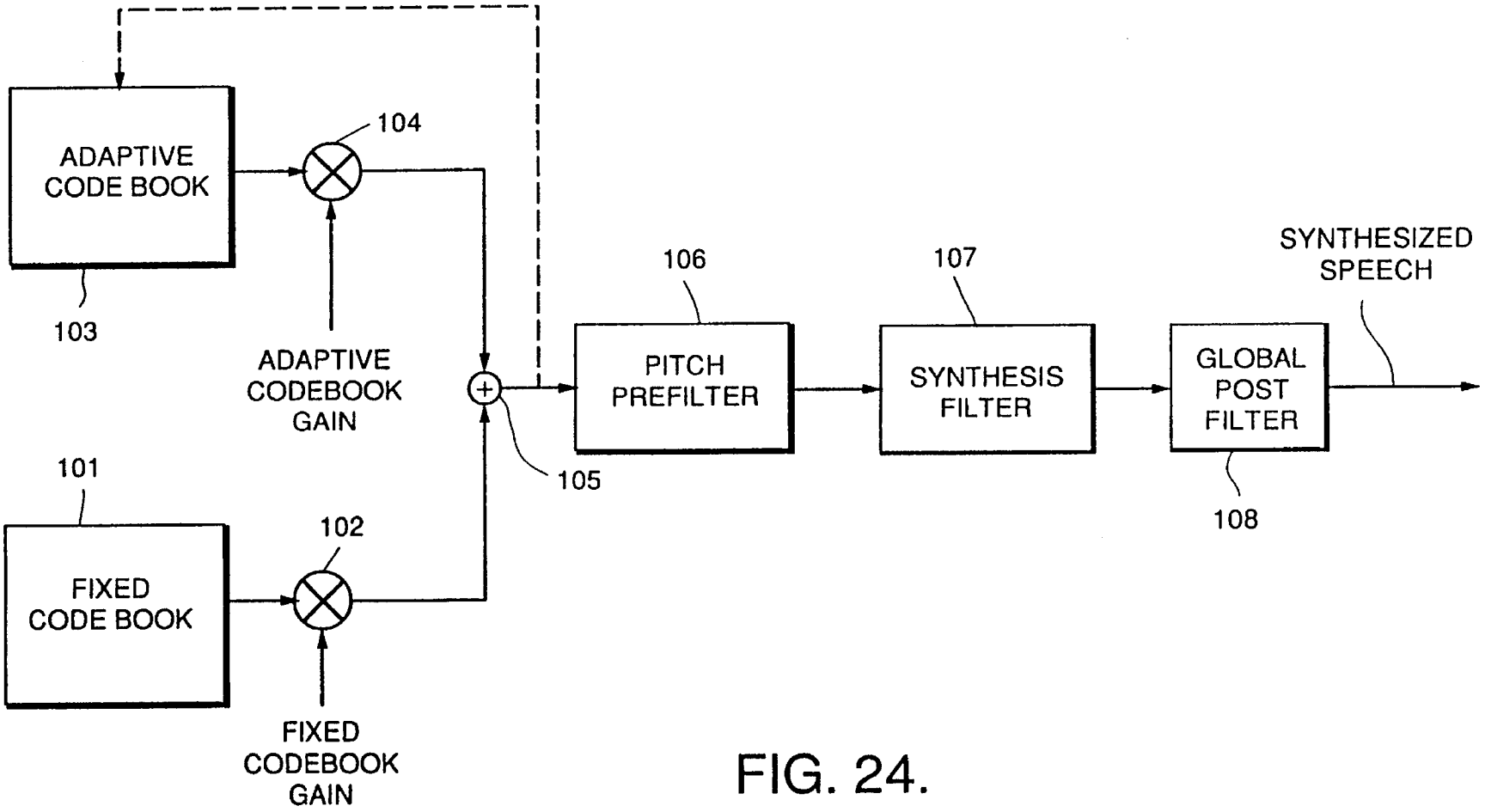
FIG. 24 is a chart of speech coder parameters for mode A.

The bit allocation among various parameters is summarized in FIGS. 22A and 22B for mode A, FIG. 23 for mode B, and FIG. 24 for mode C. These parameters are packed by the packing circuitry 36 of FIG. 3. These parameters are packed in the same sequence as they are tabulated in these Figures. Thus for mode A, using the same notation as in FIGS. 22A and 22B, they are packed into a 168 bit size packet every 40 ms in the following sequence: MODE1, LSP2, ACG1, ACG3, ACG4, ACGS, ACG7, ACG2, ACG6, PITCH1, PITCH2, ACI1, SIGN1, FCG1, ACI2, SIGN2, FCG2, ACI3, SIGN3, FCG3, ACI4, SIGN4, FCG4, ACI5, SIGNS, FCG5, ACI6, SIGN6, FCG6, ACI7, SIGN7, FCG7, FCI12, FCI34, FCI56, AND FCI7. For mode B, using the same notation as in FIGS. 22A and 22B, the parameters are packed into a 168 bit size packet every 40 ms in the following sequence: MODE1, LSP2, ACG1, ACG2, ACG3, ACG4, ACG5, ACI1, FCG1, FCI1, ACI2, FCG2, FCI2, ACI3, FCG3, FCI3, ACI4, FCG4, FCI4, FCI4, ACI5, FCG5, FCI5, LSP1, and MODE2. For mode C, using the same notation as in FIGS. 22A and 22B, they are packed into a 168 bit size packet every 40 ms in the following sequence: MODE1, LSP2, ACG1, ACG2, ACG3, ACG4, ACG5, ACI1, FCG2_1, FCI1, ACI2, FCG2_2, FCI2, ACI3, FCG2_3, FCI3, ACI4, FCG2_4, FCI4, ACI5, FCG2_5, FCI5, FCG1_1, FCG1_2, FCG1_3, FCG1_4, FCG1_5, and MODE2. The packing sequence in all three modes is designed to reduce the sensitivity of an error in the mode bits MODE1 and MODE2.

The packing is done from the MSB or bit 7 to LSB in bit 0 from byte 1 to byte 21. MODE1 occupies the MSB or bit 7 of byte 1. By testing this bit, we can determine whether the compressed speech belongs to mode A or not. If it is not mode A, we test the MODE2 that occupies the LSB or bit 0 of byte 21 to decide between mode B and mode C.

Figure 25:
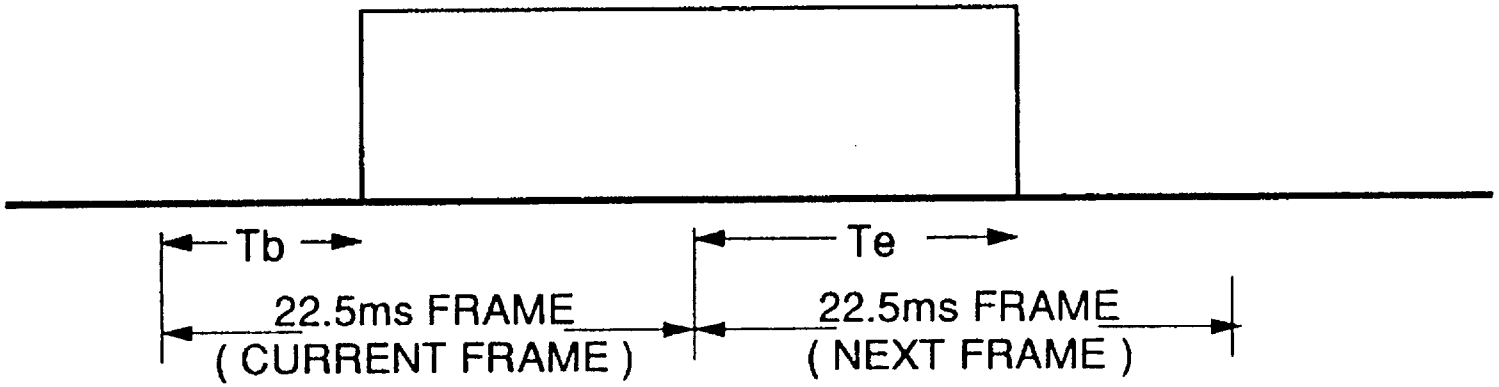
FIG. 25 is a block diagram illustrating a processing of the speech decoder shown in FIG. 4.

The speech decoder 46 (FIG. 4) is shown in FIG. 25 and receives the compressed speech bitstream in the same form as put out by the speech encoder of FIG. 3. The parameters are unpacked after determining whether the received mode bits indicate a first mode (Mode C), a second mode (Mode B), or a third mode (Mode A). These parameters are then used to synthesize the speech. Speech decoder 46 synthesizes the part of the signal corresponding to the frame, depending on the second set of filter coefficients, independently of the first set of filter coefficients and the first and second pitch estimates, when the frame is determined to be the first mode (mode C); synthesizes the part of the signal corresponding to the frame, depending on the first and second sets of filter coefficients, independently of the first and second pitch estimates, when the frame is determined to be the second mode (Mode B); and synthesizes a part of the signal corresponding to the frame, depending on the second set of filter coefficients and the first and second pitch estimates, independently of the first set of filter coefficients, when the frame is determined to be the third mode (mode A).

In addition, the speech decoder receives a cyclic redundancy check (CRC) based bad frame indicator from the channel decoder 45 (FIG. 1). This bad frame indictor flag is used to trigger the bad frame error masking and error recovery sections (not shown) of the decoder. These can also be triggered by some built-in error detection schemes.

Speech decoder 46 tests the MSB or bit 7 of byte 1 to see if the compressed speech packet corresponds to mode A. Otherwise, the LSB or bit 0 of byte 21 is tested to see if the packet corresponds to mode B or mode C. Once the correct mode of the received compressed speech packet is determined, the parameters of the received speech frame are unpacked and used to synthesize the speech. In addition, the speech decoder receives a cyclic redundancy check (CRC) based bad frame indicator from the channel decoder 25 in FIG. 1. This bad frame indicator flag is used to trigger the bad frame masking and error recovery portions of speech decoder. These can also be triggered by some built-in error detection schemes.

In mode A, the received second set of line spectral frequency indices are used to reconstruct the quantized filter coefficients which then are converted to autocorrelation lags. In each subframe, the autocorrelation lags are interpolated using the same weights as used in the encoder for mode A and then converted to short term predictor filter coefficients. The open loop pitch indices are converted to quantized open loop pitch values. In each subframe, these open loop values are used along with each received 5-bit adaptive codebook index to determine the pitch delay candidate. The adaptive codebook vector corresponding to this delay is determined from the adaptive codebook 103 in FIG. 24. The adaptive codebook gain index for each subframe is used to obtain the adaptive codebook gain which then is applied to the multiplier 104 to scale the adaptive codebook vector. The fixed codebook vector for each subframe is inferred from the fixed codebook 101 from the received fixed codebook index associated with that subframe and this is scaled by the fixed codebook gain, obtained from the received fixed codebook gain index and the sign index for that subframe, by multiplier 102. Both the scaled adaptive codebook vector and the scaled fixed codebook vector are summed by summer 105 to produce an excitation signal which is enhanced by a pitch prefilter 106 as described in L. A. Gerson and M. A. Jasuik, supra. This enhanced excitation signal is used to derive the short term predictor 107 and the synthesized speech is subsequently further enhanced by a global pole-zero filter 109 with built in spectral tilt correction and energy normalization. At the end of each subframe, the adaptive codebook is updated by the excitation signal as indicated by the dotted line in FIG. 25.

In mode B, both sets of line spectral frequency indices are used to reconstruct both the first and second sets of quantized filter coefficients which subsequently are converted to autocorrelation lags. In each subframe, these autocorrelation lags are interpolated using exactly the same weights as used in the encoder in mode B and then converted to short term predictor coefficients. In each subframe, the received adaptive codebook index is used to derive the adaptive codebook vector from the adaptive codebook 103 and the received fixed codebook index is used to derive the fixed codebook gain index are used in each subframe to retrieve the adaptive codebook gain and the fixed codebook gain. The excitation vector is reconstructed by scaling the adaptive codebook vector by the adaptive codebook gain using multiplier 104, scaling the fixed codebook vector by the fixed codebook gain using multiplier 102, and summing them using summer 105. As in mode A, this is enhanced by the pitch prefilter 106 prior to synthesis by the short term predictor 107. The synthesized speech is further enhanced by the global pole-zero postfilter 108. At the end of each subframe, the adaptive codebook is updated by the excitation signal as indicated by the dotted line in FIG. 24.

In mode C, the received second set of line spectral frequency indices are used to reconstruct the quantized filter coefficients which then are converted to autocorrelation lags. In each subframe, the autocorrelation lags are interpolated using the same weights as used in the encoder for mode C and then converted to short term predictor filter coefficients. In each subframe, the received adaptive codebook index is used to derive the adaptive codebook vector from the adaptive codebook 103 and the received fixed codebook index is used to derive the fixed codebook vector from the fixed codebook 101. The adaptive codebook gain index and the fixed codebook gain indices are used in each subframe to retrieve the adaptive codebook gain and the fixed codebook gains for both halves of the subframe. The excitation vector is reconstructed by scaling the adaptive codebook vector by the adaptive codebook gain using multiplier 104, scaling the first half of the fixed codebook vector by the first fixed codebook gain using multiplier 102 and the second half of the fixed codebook vector by the second fixed codebook gain using multiplier 102, and summing the scaled adaptive and fixed codebook vectors using summer 105. As in modes A and B, this is enhanced by the pitch prefilter 106 prior the synthesis by the short term predictor 107. The synthesized speech is further enhanced by the global pole-zero postfilter 108. The parameters of the pitch prefilter and global postfilter used in each mode are different and are tailored to each mode. At the end of each subframe, the adaptive codebook is updated by the excitation signal as indicated by the dotted line in FIG. 24.

As an alternative to the illustrated embodiment, the invention may be practiced with a shorter frame, such as a 22.5 ms frame, as shown in FIG. 25. With such a frame, it might be desirable to process only one LP analysis window per frame, instead of the two LP analysis windows illustrated. The analysis window might begin after a duration $T_b$ relative to the beginning of the current frame and extend into the next frame where the window would end after a duration $T_e$ relative to the beginning of the next frame, where $T_e > T_b$. In other words, the total duration of an analysis window could be longer than the duration of a frame, and two consecutive windows could, therefore, encompass a particular frame. Thus, a current frame could be analyzed by processing the analysis window for the current frame together with the analysis window for the previous frame.

Thus, the preferred communication system detects when noise is the predominant component of a signal frame and encodes a noise-predominated frame differently than for a speech-predominated frame. This special encoding for noise avoids some of the typical artifacts produced when noise is encoded with a scheme optimized for speech. This special encoding allow improved voice quality in a low rate bit-rate codec system.

Additional advantages and modifications will readily occur to those skilled in the art. The invention in its broader aspects is therefore not limited to the specific details, representative apparatus, and illustrative examples shown and described. Various modifications and variations can be made to the present invention without departing from the scope or spirit of the invention, and it is intended that the present invention cover the modifications and variations provided they come within the scope of the appended claims and their equivalents.

What is claimed is:

1. A method of encoding a signal having a speech component, the signal being organized as a plurality of frames, the method comprising the steps, performed for each frame, of:

analyzing a first linear prediction window to generate a first set of filter coefficients for a frame;

analyzing a second linear prediction window to generate a second set of filter coefficients for the frame;

analyzing a first pitch analysis window to generate a first pitch estimate for the frame;

analyzing a second pitch analysis window to generate a second pitch estimate for the frame;

determining whether the frame is one of a first mode, a second mode and a third mode, depending on measures of energy content of the frame and spectral content of the frame;

encoding the frame, depending on the second set of filter coefficients and the first and the second pitch estimates, independently of the first set of filter coefficients, when the frame is determined to be the third mode;

encoding the frame, depending on the first and the second sets of filter coefficients, independently of the first and the second pitch estimates, when the frame is determined to be the second mode; and encoding the frame, depending on the second set of filter coefficients, independently of the first set of filter coefficients and the first and the second pitch estimates, when the frame is determined to be the first mode.

2. The method of claim 1, wherein the determining step includes the substep of:

determining a mode depending on a determined mode of a previous frame.

3. The method of claim 1 wherein the determining step includes the substep of:

determining the mode to be the first mode only when the determined mode of a previous frame is either the first mode or the second mode.

4. The method of claim 1, wherein the determining step includes the substep of:

determining the mode to be the third mode only when the determined mode of a previous frame is either the third mode or the second mode.

5. The method of claim 1 wherein the determining step further depends on measures of pitch stationarity between the frame and a previous frame.

6. The method of claim 1 wherein the determining step further depends on measures of short-term level gradient within the frame.

7. The method of claim 1 wherein the determining step further depends on measures of a zero-crossing rate within the frame.

8. The encoding method of claim 1, wherein the first linear prediction window is contained within the frame and the second linear prediction window begins during the frame and extends into the next frame.

9. The encoding method of claim 1, wherein the first pitch estimate window is contained within the frame and the second pitch estimate window begins during the frame and extends into the next frame.

10. The encoding method of claim 1, wherein a frame determined to be of a third mode contains a signal with a speech component composed of primarily voiced speech.

11. The encoding method of claim 1, wherein a frame determined to be of a second mode contains a signal with a speech component composed of primarily unvoiced speech.

12. The encoding method of claim 1, wherein a frame determined to be of a first mode contains a signal with a low speech component.

13. An encoder for encoding a signal having a speech component, the signal being organized as a plurality of frames, comprising:

a filter coefficient generator for analyzing a first linear prediction window to generate a first set of filter coefficients for a frame and for analyzing a second linear prediction window to generate a second set of filter coefficients for the frame;

a pitch estimator for analyzing a first pitch analysis window to generate a first pitch estimate for the frame and analyzing a second pitch analysis window to generate a second pitch estimate for the frame;

a mode determinator for determining whether the frame is one of a first mode, a second mode and a third mode, depending on measures of energy content of the frame and spectral content of the frame; and a frame encoder for encoding the frame depending on the determined mode of the frame, wherein a frame determined to be of a third mode is encoded depending on the second set of filter coefficients and the first and the second pitch estimates, independently of the first set of filter coefficients, a frame determined to be of a second mode is encoded depending on the first and the second sets of filter coefficients, independently of the first and the second pitch estimates, and a frame determined to be of a first mode is encoded depending on the second set of filter coefficients, independently of the first set of filter coefficients and the first and the second pitch estimates.

14. The encoder of claim 13, wherein the mode determinator determines the mode depending on a determined mode of a previous frame.

15. The encoder of claim 13, wherein the mode determinator determines the frame to be of the first mode only when the determined mode of a previous frame is either the first mode or the second mode.

16. The encoder of claim 13, wherein the mode determininator determines the frame to be of the third mode only when the determined mode of a previous frame is either the third mode or the second mode.

17. The encoder of claim 13 wherein the mode determininator further depends on measures of pitch stationarity between the frame and a previous frame.

18. The encoder of claim 13 wherein the mode determinator further depends on measures of short-term level gradient within the frame.

19. The encoder of claim 13 wherein the mode determinator further depends on measures of a zero-crossing rate within the frame.

20. The encoder of claim 13, wherein the first linear prediction window is contained within the frame and the second linear prediction window begins during the frame and extends into the next frame.

21. The encoder of claim 13, wherein the first pitch estimate window is contained within the frame and the second pitch estimate window begins during the frame and extends into the next frame.

22. The encoder of claim 13, wherein a frame determined to be of a third mode contains a signal with a speech component composed of primarily voiced speech.

23. The encoder of claim 13, wherein a frame determined to be of a second mode contains a signal with a speech component composed of primarily unvoiced speech.

24. The encoder of claim 13, wherein a frame determined to be of a first mode contains a signal with a low speech component.

* * * * *